US011833381B2

(12) United States Patent
Masumoto et al.

(10) Patent No.: US 11,833,381 B2
(45) Date of Patent: Dec. 5, 2023

(54) STRETCHING EXERCISE EQUIPMENT

(71) Applicant: Curves Japan Co., Ltd., Tokyo (JP)

(72) Inventors: Takeshi Masumoto, Tokyo (JP); Keiko Machida, Tokyo (JP); Kenta Kasahara, Tokyo (JP)

(73) Assignee: Curves Japan Co., Ltd., Tokyo (JP)

( * ) Notice: Subject to any disclaimer, the term of this patent is extended or adjusted under 35 U.S.C. 154(b) by 267 days.

(21) Appl. No.: 17/226,490

(22) Filed: Apr. 9, 2021

(65) Prior Publication Data

US 2021/0220689 A1 Jul. 22, 2021

Related U.S. Application Data

(63) Continuation of application No. PCT/JP2019/040880, filed on Oct. 17, 2019.

(30) Foreign Application Priority Data

Oct. 18, 2018 (JP) ..... 2018-196675

(51) Int. Cl.
*A63B 17/02* (2006.01)
*A63B 1/00* (2006.01)
*A63B 23/00* (2006.01)

(52) U.S. Cl.
CPC ..... *A63B 17/02* (2013.01); *A63B 1/00* (2013.01); *A63B 2023/006* (2013.01)

(58) Field of Classification Search
CPC ..... A63B 17/02; A63B 1/00; A63B 2023/006; A63B 21/0552; A63B 21/4037; A63B 2071/0694; A63B 2225/10; A63B 21/4029
See application file for complete search history.

(56) References Cited

U.S. PATENT DOCUMENTS 2,873,457 A * 2/1959 Joy ..... A61G 7/015 5/83.1
3,948,513 A * 4/1976 Pfotenhauer ..... A63B 17/04 482/142

(Continued)

FOREIGN PATENT DOCUMENTS

CN 106511036 3/2017
JP S60-029155 2/1985

(Continued)

OTHER PUBLICATIONS

International Search Report for PCT/JP2019/040880 dated Dec. 17, 2019.

(Continued)

*Primary Examiner* — Garrett K Atkinson
(74) *Attorney, Agent, or Firm* — IPUSA, PLLC

(57) ABSTRACT

An exercise equipment arranged on a floor so as to surround an exerciser and to have a frame having a shape that lacks one side of a rectangle, includes a first longitudinal horizontal bar connected to the frame, arranged at a predetermined height from the frame, and aligned in a depth direction, a first transverse horizontal bar connected to the frame, having one end thereof connected to the first longitudinal horizontal bar, and aligned in a direction different from the first longitudinal horizontal bar, a vertical bar connected to the frame, and having a height from the frame that is higher than the first transverse horizontal bar, and a second longitudinal horizontal bar connected to the frame, arranged in parallel to the first longitudinal horizontal bar, and spaced from another end of the first transverse horizontal bar.

10 Claims, 32 Drawing Sheets

(56) References Cited

U.S. PATENT DOCUMENTS 4,306,715 A * 12/1981 Sutherland ..... A63B 21/078 482/104
4,564,193 A * 1/1986 Stewart ..... A63B 23/1209 482/142
4,564,194 A * 1/1986 Dawson ..... A63B 21/0626 482/102
4,856,773 A * 8/1989 Deola ..... A63B 21/0626 482/102
4,955,604 A * 9/1990 Pogue ..... A63B 21/0783 482/99
5,082,260 A * 1/1992 Dinelli ..... A63B 21/4029 482/104
5,100,128 A * 3/1992 Mabry ..... A63B 21/4035 482/137
5,105,803 A * 4/1992 Burton ..... A61H 1/0218 602/19
5,306,220 A * 4/1994 Kearney ..... A63B 23/00 482/99
5,346,448 A * 9/1994 Sollo ..... A63B 21/00181 482/99
D404,443 S * 1/1999 Doyle ..... D21/675
7,070,546 B1 * 7/2006 Grasso ..... A63B 21/072 482/145
7,104,939 B1 * 9/2006 Martinez ..... A63B 21/4045 482/148
7,534,200 B1 * 5/2009 Martinez ..... A63B 23/02 482/142
7,731,631 B2 * 6/2010 Collias ..... A63B 21/0783 482/38
9,050,496 B2 * 6/2015 Towley, III ..... A63B 21/062
10,646,740 B2 * 5/2020 Lee ..... A63B 21/156
2002/0123415 A1 * 9/2002 Marques ..... A63B 17/00 482/904
2006/0183607 A1 * 8/2006 Collias ..... A63B 21/078 482/142
2008/0113852 A1 * 5/2008 Caldwell ..... A63B 23/03541 482/133
2009/0286658 A1 * 11/2009 James ..... A63B 21/078 482/104
2012/0142500 A1 * 6/2012 Ronan ..... A63B 5/11 482/29
2013/0203565 A1 * 8/2013 Floyd ..... A63B 21/0628 482/102
2017/0065478 A1 * 3/2017 Takashima ..... A63B 21/4011

FOREIGN PATENT DOCUMENTS

| | | |
|---|---|---|
| JP | 3079177 | 8/2001 |
| JP | 3133019 | 6/2007 |
| JP | 2008-073435 | 4/2008 |
| JP | 2012-000393 | 1/2012 |
| WO | 2017/127953 | 8/2017 |

OTHER PUBLICATIONS

TRUE Inc., "TRUE Stretch Inc.", "Online", "Searched on Sep. 5, 2018" by Internet <URL: https://www.truefitness.com/commercial-fitness/flexibility/true-stretch/>.
Chinese Office Action for 201980066323.1 dated Mar. 7, 2022.
Extended European Search Report for 19873934.4 dated Nov. 26, 2021.

* cited by examiner

STRETCHING EXERCISE EQUIPMENT

CROSS-REFERENCE TO RELATED APPLICATIONS

This U.S. non-provisional application is a continuation of PCT International Application PCT/JP2019/040880 filed on Oct. 17, 2019 and designated the U.S., which is based on and claims priority to Japanese Patent Applications No. 2018-196675 filed on Oct. 18, 2018, with the Japan Patent Office. The entire contents of these applications are incorporated herein by reference.

BACKGROUND OF THE INVENTION

1. Field of the Invention

The disclosures herein relate to a stretching exercise equipment.

2. Description of the Related Art

Exercise equipment to support exercise, such as stretching, is known.

Specifically, equipment is known in which a person who is engaged in exercises such as stretching (hereinafter referred to as "an exerciser") performs exercises corresponding to a specific part of the body that a person wants to train, such as muscles or joints, or a specific part of the body that the person wants to rehabilitate (for example, Non-Patent Document 1, etc.).

However, in conventional equipment, bars (including auxiliary bars, etc.) constituting the equipment are many, and such many bars tend to push pressure on exercisers. Thus, when the exercisers see the equipment, the exercisers may be reluctant to use the equipment to exercise or may have a feeling of failure to exercise.

Accordingly, it may be preferred to reduce a feeling of pressure felt by exercisers.

RELATED-ART DOCUMENT

Patent Documents

Non-patent Document 1: TRUE Inc., "TRUE Stretch (Registered Trademark) Inc.", "Online", "Searched on Sep. 5, 2018" by Internet <URL: https://www.truefitness.com/commercial-fitness/flexibility/true-stretch/>

SUMMARY OF THE INVENTION

According to an embodiment, an exercise equipment arranged on a floor so as to surround an exerciser and to have a frame having a shape that lacks one side of a rectangle, includes a first longitudinal horizontal bar connected to the frame, arranged at a predetermined height from the frame, and aligned in a depth direction, a first transverse horizontal bar connected to the frame, having one end thereof connected to the first longitudinal horizontal bar, and aligned in a direction different from the first longitudinal horizontal bar, a vertical bar connected to the frame, and having a height from the frame that is higher than the first transverse horizontal bar, and a second longitudinal horizontal bar connected to the frame, arranged in parallel to the first longitudinal horizontal bar, and spaced from another end of the first transverse horizontal bar, wherein a space is provided by separating the first transverse horizontal bar and the second longitudinal horizontal bar, wherein a bar parallel to the first longitudinal horizontal bar or the first transverse horizontal bar is not arranged inside the frame so as to provide a space therein, wherein the first transverse horizontal bar and the second longitudinal horizontal bar are arranged at same height, wherein the first transverse horizontal bar and the first longitudinal horizontal bar are connected to the vertical bar, wherein the first longitudinal horizontal bar and the second longitudinal horizontal bar are spaced apart, wherein the first longitudinal horizontal bar, the first transverse horizontal bar, and the second longitudinal horizontal bar are arranged so as to surround the exerciser, and wherein the first transverse horizontal bar includes a portion protruding outward of the frame.

According to at least one embodiment, a feeling of pressure felt by exercisers can be reduced.

DESCRIPTION OF THE PREFERRED EMBODIMENTS

Figure 1:
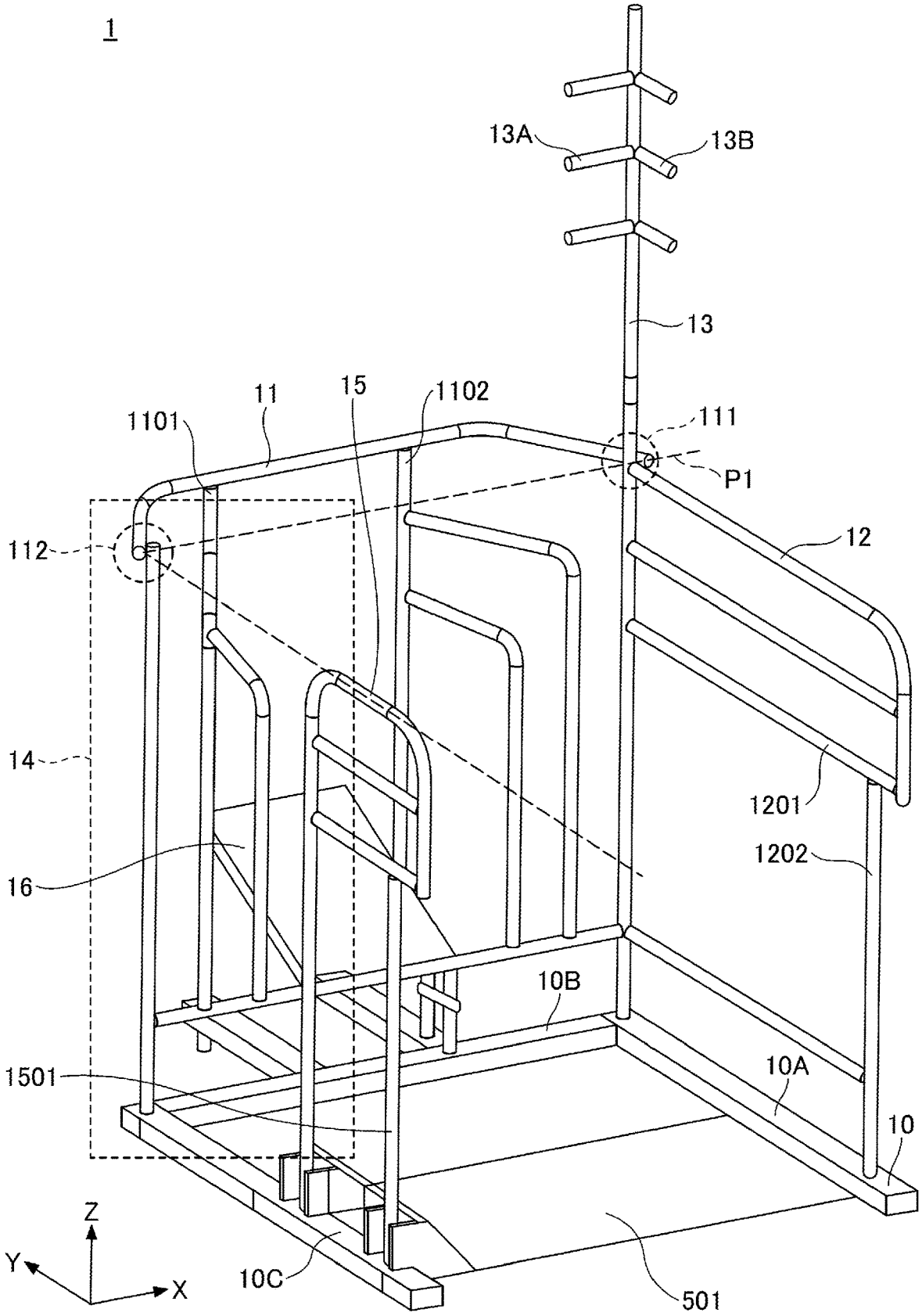
FIG. 1 is a diagram illustrating an exemplary entire configuration of an exercise equipment.

Hereinafter, the details of each embodiment will be described with reference to the accompanying drawings. In the description and drawings in each embodiment, the components having substantially the same functional configuration are not described in duplicate by adding the same reference numerals.

First Embodiment

<Example of Entire Configuration>

FIG. 1 is a diagram illustrating an exemplary entire configuration of an exercise equipment. For example, an exercise equipment 1 is an equipment as illustrated.

FIGS. 2 to 6 are diagrams illustrating examples of the exercise equipment.

Figure 2:
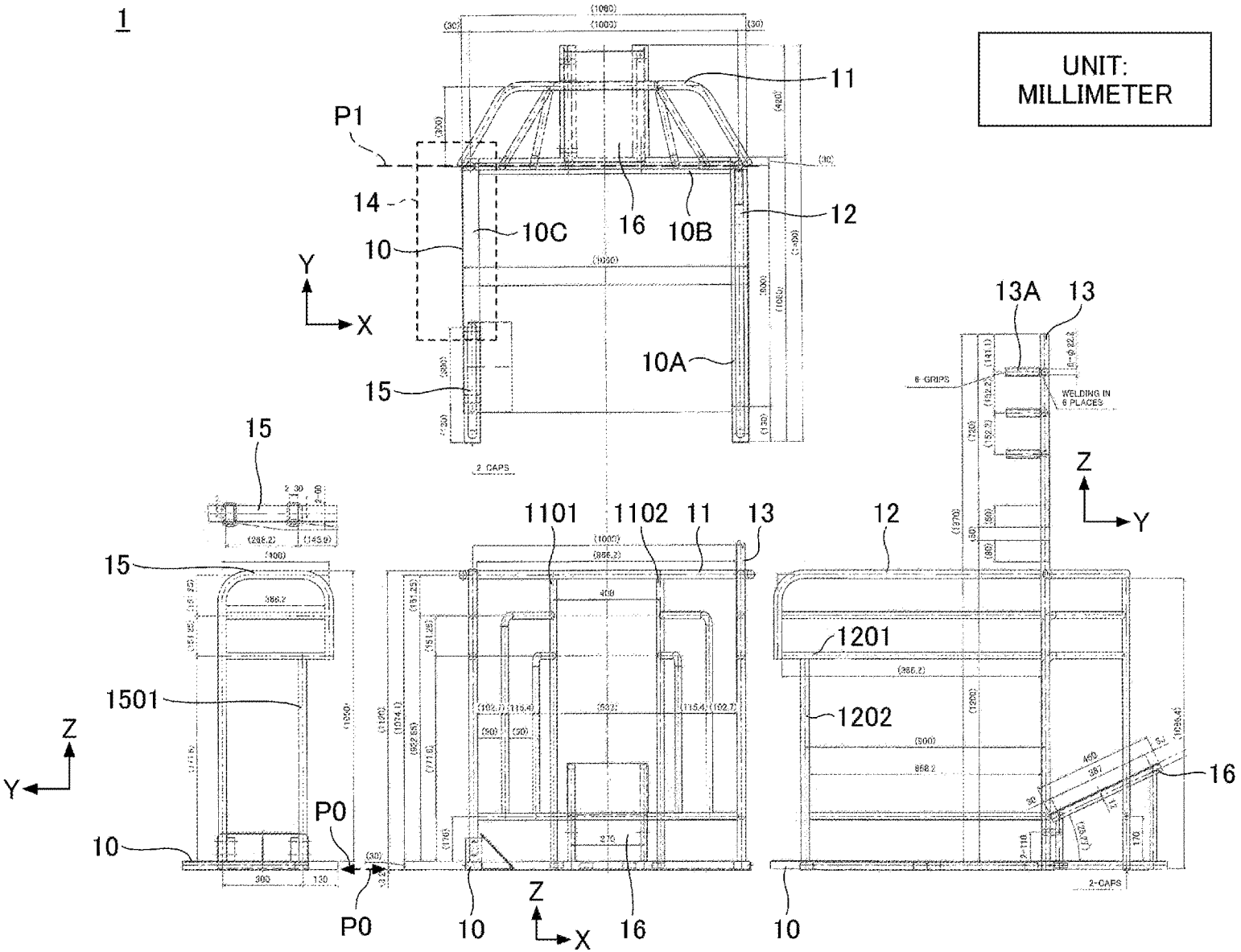
FIG. 2 is diagrams illustrating an overview of a front view, a plan view, a right-side view, and a left-side view of an exemplary entire configuration of an exercise equipment.

FIG. 2 is a diagram illustrating an overview of a front view, a plan view, a right-side view, and a left-side view of an exemplary entire configuration of the exercise equipment. Hereinafter, FIG. 2 will be described with reference to FIGS. 3 to 6.

Figure 3:
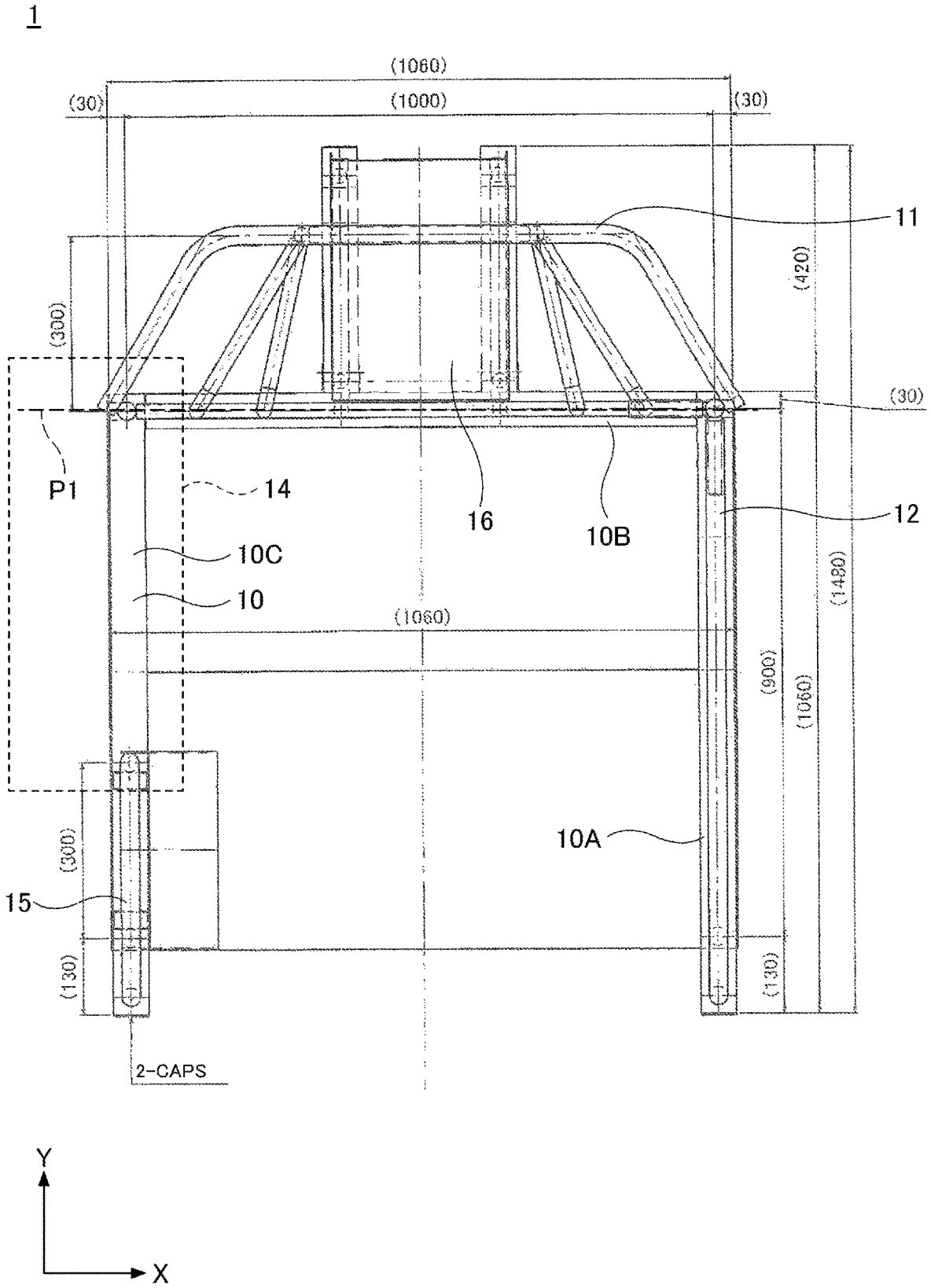
FIG. 3 is a diagram illustrating an example of a plan view of an exercise equipment.
Figure 4:
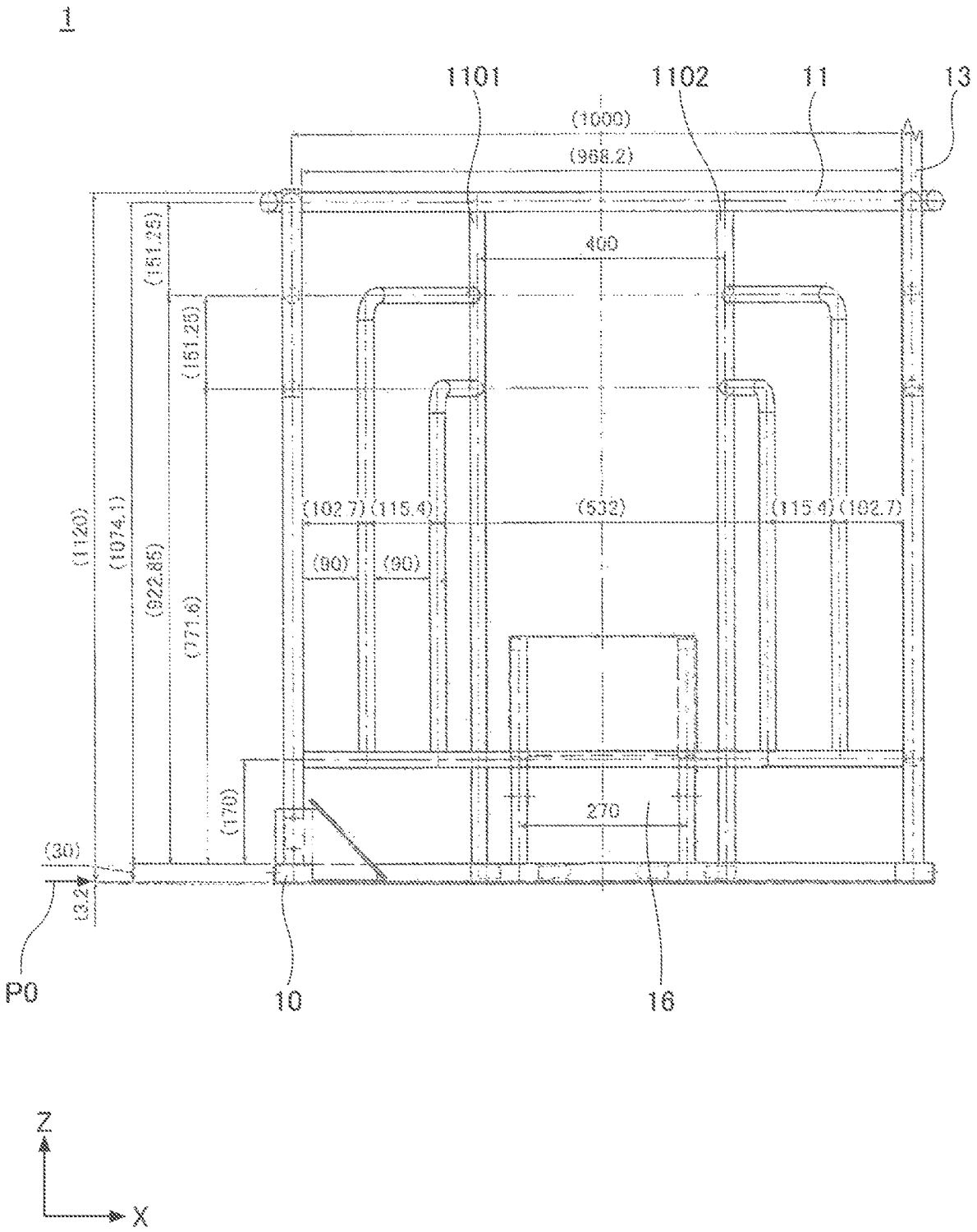
FIG. 4 is a diagram illustrating an example of a front view of an exercise equipment.
Figure 5:
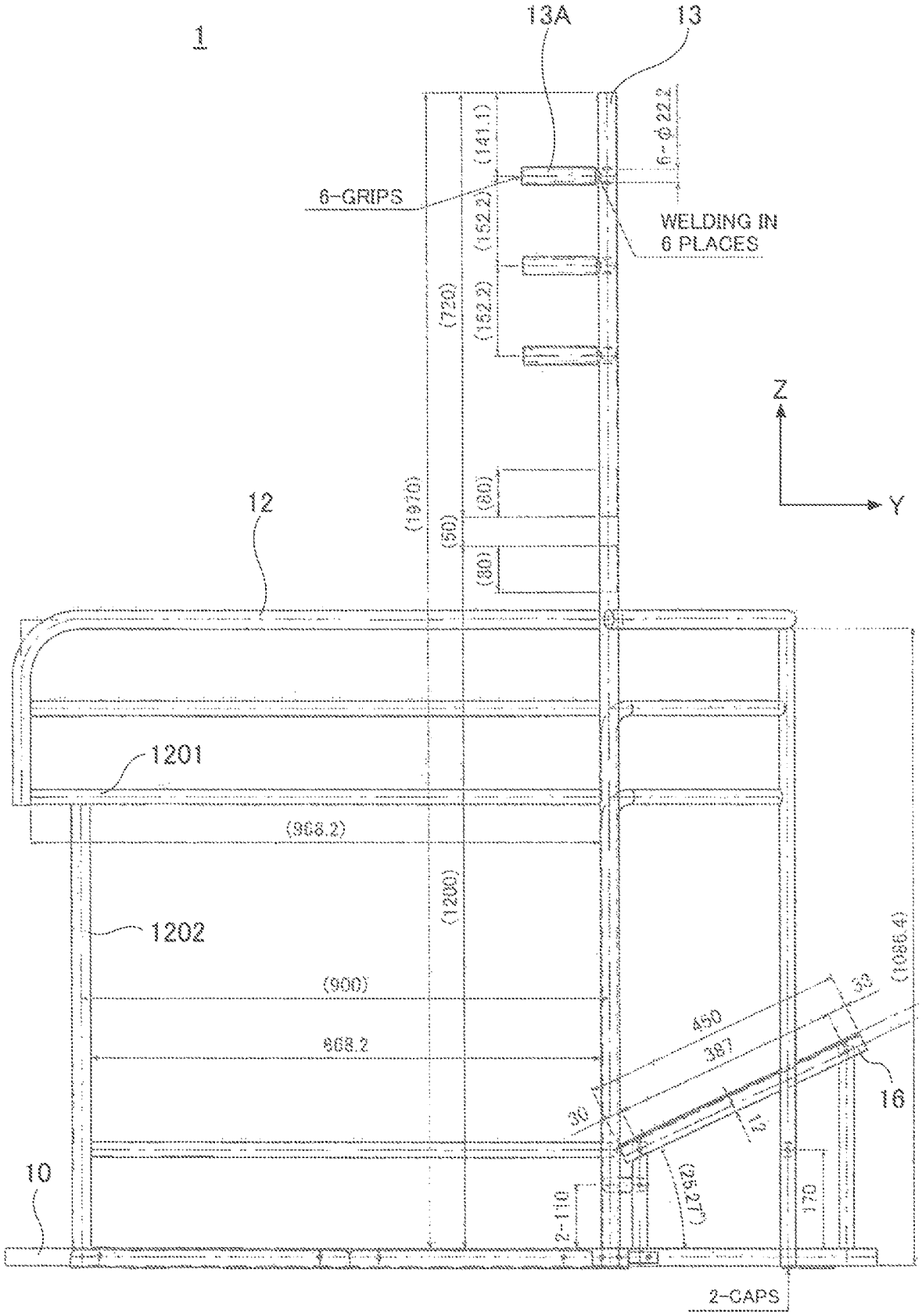
FIG. 5 is a diagram illustrating an example of a right-side view of an exercise equipment.
Figure 6:
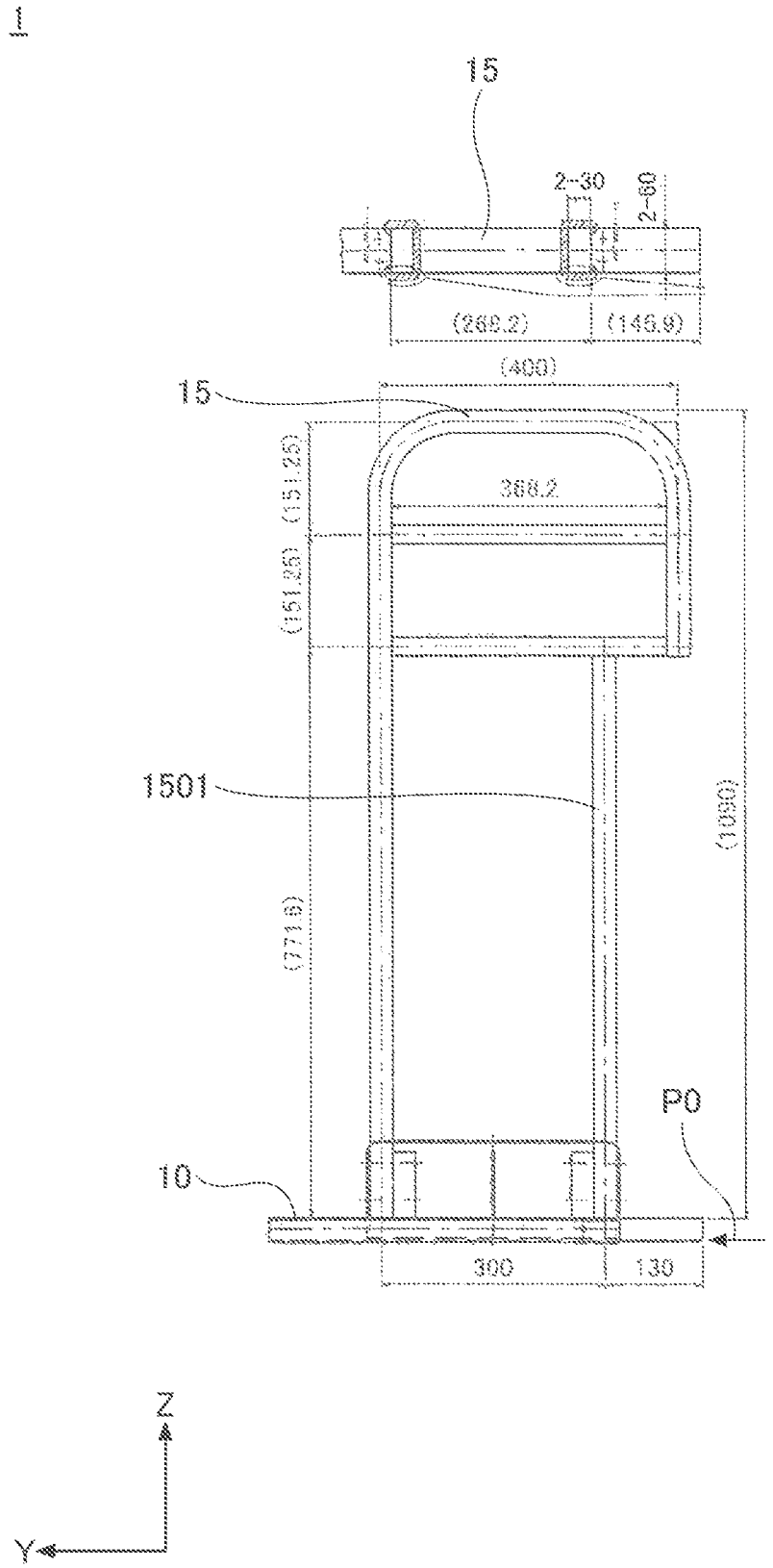
FIG. 6 is a diagram illustrating an example of a left-side view of an exercise equipment.

FIG. 3 is a diagram illustrating an example of a plan view of the exercise equipment. FIG. 4 is a diagram illustrating an example of a frontal view of the exercise equipment. FIG. 4 is a diagram illustrating a front view of the equipment in which a part of a vertical bar 13 is omitted. FIG. 5 is a diagram illustrating an example of a right-side view of the exercise equipment. Specifically, FIG. 5 is a side view of the right-side of the equipment. FIG. 6 is a diagram illustrating an example of the left-side view of the exercise equipment. Specifically, FIG. 6 is a side view of the left-side of the exercise equipment. As illustrated, the vertical bar 13 is preferably as high as, for example, 2000 millimeters.

Hereinafter, a person to use the exercise equipment 1 (also called, exerciser) will perform an exercise with the X-axis direction in the figure set to the right-hand direction at the initial position. In the following description, the X-axis direction is also referred to as the "horizontal direction". Further, the Y-axis direction is a direction perpendicular to the X-axis direction. Then, at the initial position, the Y-axis direction is a depth direction from the viewpoint of an exerciser. Therefore, in the following description, the Y-axis direction is also referred to as the "depth direction". The Z-axis direction is a, so-called gravitational direction. Therefore, the Z-axis direction is a vertical direction from the viewpoint of the exerciser. Therefore, in the following description, the Z-axis direction is also referred to as the "vertical direction".

First, as illustrated in the drawings, the exercise equipment 1 includes a frame (hereinafter, simply referred to as the "frame 10") having a shape that lacks one side of a rectangle and that is constituted by a first frame 10A that abuts on the floor surface and is placed in the depth direction, a second frame 10B that is placed in the horizontal direction, and a third frame 10C which is placed in the depth direction. For example, the exercise equipment 1 includes at least a transverse horizontal bar 11, a longitudinal horizontal bar 12, and a vertical bar 13. As illustrated, the frame 10 is placed so that the bar, which includes the vertical bar 13 and the like, is vertical. As illustrated, the transverse horizontal bar 11, the longitudinal horizontal bar 12, and the vertical bar 13 are directly or indirectly connected to the frame 10. As illustrated in the drawings, the transverse horizontal bar 11 and the longitudinal horizontal bar 12 are arranged at a predetermined height via other bars and the like.

The transverse horizontal bar 11 is an example of a first transverse horizontal bar and is placed in the X-axis direction as illustrated.

The longitudinal horizontal bar 12 is an example of the first longitudinal horizontal bar and is placed in the Y-axis direction as illustrated.

The vertical bar 13 is placed in the Z-axis direction, for example, as illustrated. The vertical bar 13 is also placed, for example, perpendicular to the transverse horizontal bar 11 and the longitudinal horizontal bar 12. Moreover, the vertical bar 13 is located higher than the transverse horizontal bar 11 and the longitudinal horizontal bar 12 in the Z-axis direction.

The transverse horizontal bar 11 is connected to the vertical bar 13 by an end (for example, the right end of the transverse horizontal bar 11 in the figure; hereinafter referred to as the "end 111") which is an example of one end of the first transverse horizontal bar in the example illustrated. On the other hand, a longitudinal horizontal bar 15, which is an example of the second longitudinal horizontal bar, is placed parallel to the longitudinal horizontal bar 12 on the other end of the first transverse horizontal bar (for example, the left end of the transverse horizontal bar 11 in the drawings; hereinafter referred to as the "end 112").

The longitudinal horizontal bar 15 is spaced from the end 112. Accordingly, as illustrated, there is a space 14 between the end of the longitudinal horizontal bar 15 and the end 112. Thus, exercisers are less likely to feel pressure, because the exercise equipment has the space 14 and has fewer bars in the exercise equipment.

The longitudinal horizontal bar 15 is also placed on an extension from the end 112. In the example illustrated, the end 112 is not parallel to the Y-axis direction and has an angle with respect to the Y-axis direction. Strictly speaking, the longitudinal horizontal bar 15 is not placed on the extension even though the end 112 is extended. However, the extension of the longitudinal horizontal bar 15 crosses the end 112. Thus, if the longitudinal horizontal bar 15 is placed on a line parallel to the Y-axis direction that intersects the end 112, it is also considered to be an "extension of the end 112". The same applies to the other end.

The space 14 is "900 millimeters (mm)−300 millimeters (mm)=600 millimeters (mm)" in the example illustrated in FIG. 3. It is preferable that the space 14 is about 400 mm to 700 mm.

In addition, the width of the space 14 may be adjusted depending on the size or the like of the exerciser using the exercise equipment 1.

Hereinafter, the relationship between the frame 10, the transverse horizontal bar 11, the longitudinal horizontal bar 12, the vertical bar 13, and the longitudinal horizontal bar 15 will be described in detail.

The longitudinal horizontal bar 12, which is an example of the first transverse horizontal bar, is connected to the frame 10 via an auxiliary bar 1201, a first support bar 1202, and the vertical bar 13.

The transverse horizontal bar 11, which is an example of the first transverse horizontal bar, is connected to the frame 10 via a second support bar 1101, a third support bar 1102, and the vertical bar 13.

The vertical bar 13 is directly connected to the frame 10.

The longitudinal horizontal bar 15, which is an example of the second transverse horizontal bar, is directly connected to the frame 10. Specifically, the longitudinal horizontal bar 15 is shaped to include an inverted U-shape. One end of the inverted U-shape has a long shape, and the longitudinal horizontal bar 15 is directly connected to the frame 10. In contrast, the longitudinal horizontal bar 15 has a short shape at the other end of the inverted U-shape and is connected to the frame 10 via a fourth support bar 1501.

Each of the above-described bars may be connected indirectly via another bar or may be connected directly. Each of the above-described bars may also be formed by connecting a plurality of bars. The same applies to the bars other than the above-described bars.

The example illustrated in FIGS. 2 to 6 is an example in which the upper portion of the transverse horizontal bar 11 is "1120 mm" with reference to the reference position P0. In contrast, in FIGS. 2 to 6, there is an example in which the upper portion of the longitudinal horizontal bar 15 is placed at a height of "1090 mm" with reference to a height of "30 mm" from the reference position P0. Accordingly, this is an example in which the longitudinal horizontal bar 15 is placed at a height of "1090 mm+30 mm=1120 mm", which is the same height as the transverse horizontal bar 11, with reference to the reference position P0. It is not necessary to strictly match the height, and there may be a difference in height due to an error or the like.

In addition, when bars are arranged in different directions and the bars are arranged in two or more sides, such as the first transverse horizontal bar and the first longitudinal horizontal bar, it is easier for an exerciser to keep a balance.

Furthermore, as illustrated in the drawings, the exercise equipment 1 preferably has a configuration with fewer bars. In particular, it is desirable to have the exercise equipment with fewer bars at a position higher than the transverse horizontal bar 11 or the longitudinal horizontal bar 12. In other words, the exercise equipment with fewer bars at the position above the head and upper body of the exerciser is desirable, and a configuration of the exercise equipment is desirably a configuration close to being hollow. Thus, an exercise equipment with fewer bars can reduce a feel of pressure on exercisers.

The transverse horizontal bar 11 preferably includes a protruding portion in the depth direction from the frame position P1 representing a center line of the second frame 10B in the depth direction. Specifically, in the present embodiment, a protruding amount in the depth direction in the protruding portion is, for example, 300 mm.

In the example, the frame position P1 is at the same position as the second frame 10B in the depth direction. A shape in which the transverse horizontal bar 11 protrudes in the depth direction from the frame position P1 is desirable. This allows the inside to be wider by on account of the transverse horizontal bar 11, so that the protruding portion of the transverse horizontal bar 11, together with the space 14, can reduce a feel of pressure on exercisers.

Example of Use (Part 1)

Figure 7:
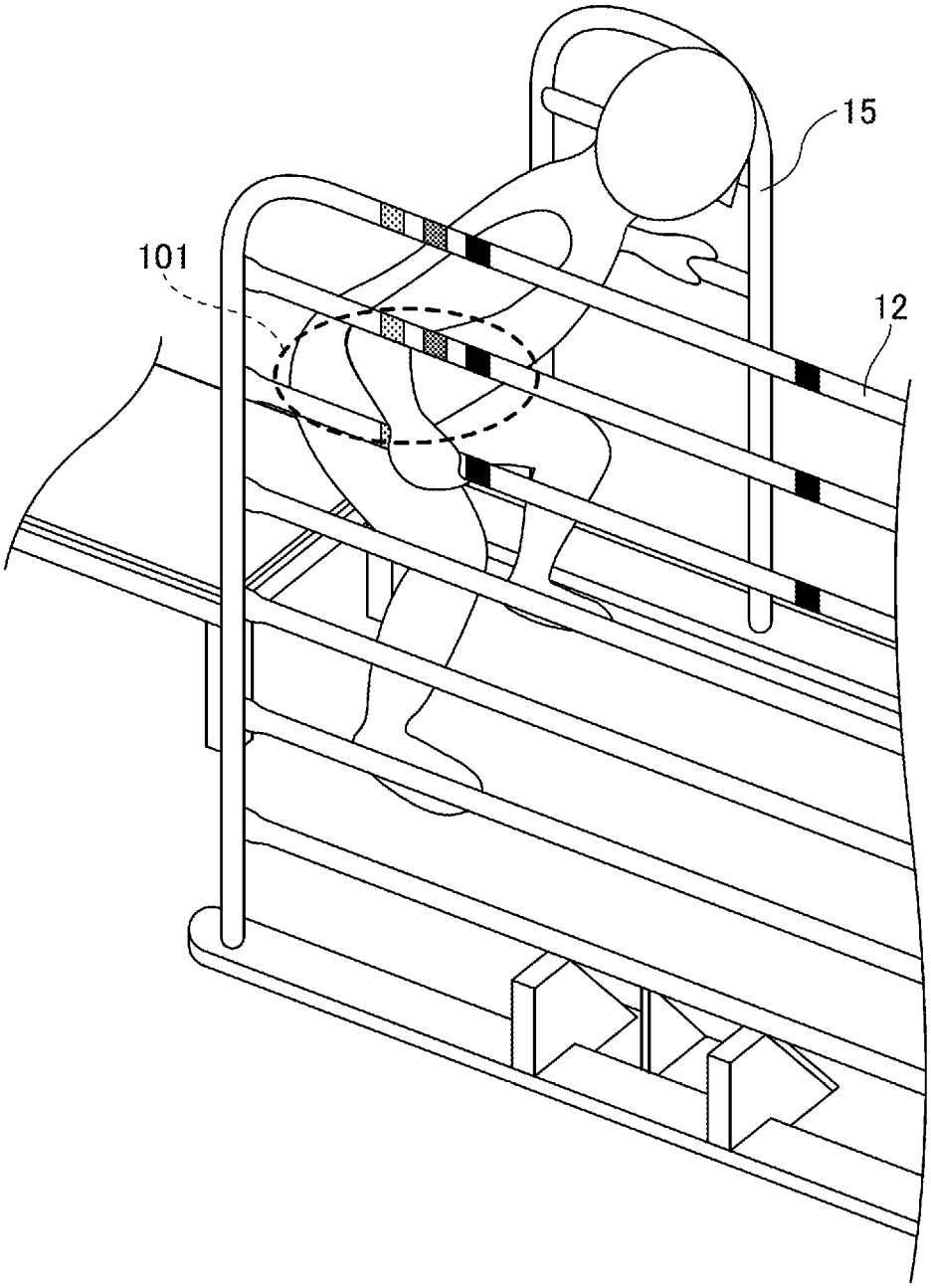
FIG. 7 is a diagram (Part 1) illustrating an example of the use of an exercise equipment of a modified example in which some of the configuration of the exercise equipment is different from the exercise equipment illustrated in FIGS. 1 to 6.

FIG. 7 is a diagram (Part 1) illustrating an example of the use of the exercise equipment in a modified embodiment, in which a part of the exercise equipment has different configurations from the configuration illustrated in FIGS. 1 to 6. For example, the exercise equipment can be used as illustrated in the drawings. Specifically, an exerciser uses the exercise equipment by gripping the longitudinal horizontal bar 15 with the left hand and the longitudinal horizontal bar 12 with the right hand, for example, when the exerciser stands up or squats.

Furthermore, a body part 101 and the like can be strengthened by performing the exercise as illustrated. For example, such exercise is preferably performed for about 50 seconds.

Example of Use (Part 2)

Figure 8:
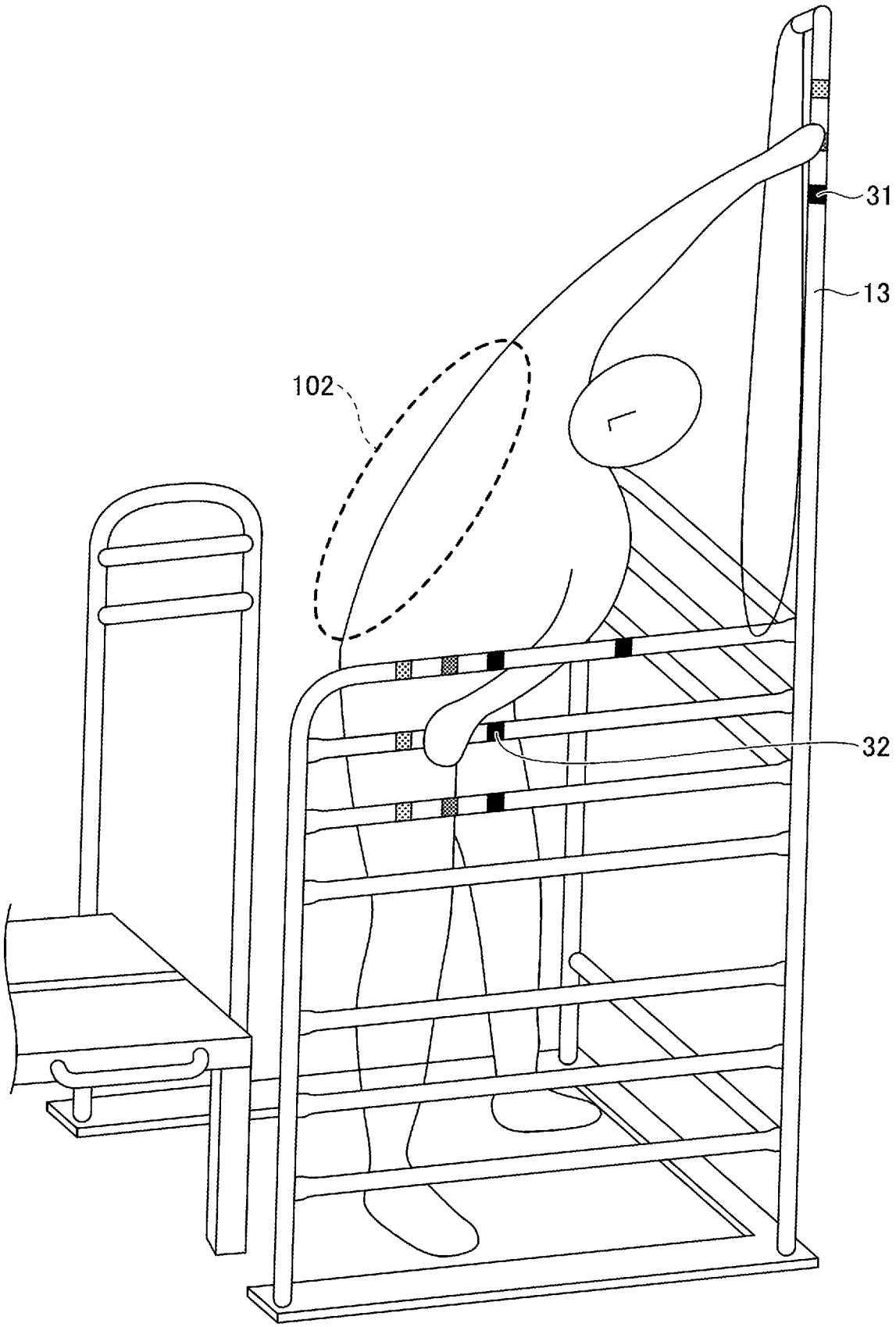
FIG. 8 is a diagram (Part 2) illustrating an example of the use of an exercise equipment of a modified example.

FIG. 8 is a diagram (Part 2) illustrating an example of the use of the exercise equipment in the modified embodiment. For example, the exercise equipment can be used as illustrated in the drawings. Specifically, in the illustrated example, the exerciser grips the vertical bar 13 with the right hand. The exerciser grips the vertical bar with the left hand. For example, such exercise is preferably performed for about 1 minute and 30 seconds.

With such exercise, the exerciser is able to stretch a body part 102, such as the latissimus dorsi muscle. Further, when the vertical bar 13 is about 2,000 mm high, the exerciser can stretch the body part 102 and the like in the standing posture. When the vertical bar 13 can be gripped, the exerciser can stabilize the body even if the exerciser takes the posture as illustrated. In addition, even a tall exerciser may be able to exercise as illustrated when the vertical bar 13 is about 2000 mm high.

It is desirable that, for example, a mark 31 and a mark 32 are provided on the vertical bar 13 and the longitudinal horizontal bar, respectively, as illustrated. The marks may be, for example, an adhesive such as a seal, a tape, and the like or paint and the like. The marks are distinguishable from other parts and may be realized by, for example, the scale, a groove, protrusion, depression, or other material in addition to coloring. Additionally, the marks may include the same color or number for each exercise.

When marks are provided in this way, it is easier for exercisers to understand where to grip and where to see.

The exercise equipment preferably has a transverse horizontal bar 13A (FIG. 1), which is an example of a second transverse horizontal bar, or a longitudinal horizontal bar 13B (FIG. 1), which is an example of a third longitudinal horizontal bar, or the like, as illustrated in FIGS. 1 to 6 for example. During the stretching of the body part 102 illustrated in FIG. 8, the exerciser grips the transverse horizontal bar 13A (FIG. 1) or the longitudinal horizontal bar 13B (FIG. 1). The presence of such bars makes it easier for the exerciser to exercise.

In the example illustrated in FIGS. 1 to 6, the number of transverse horizontal bars 13A (FIG. 1) and longitudinal horizontal bars 13B (FIG. 1) is the same. The numbers of the transverse horizontal bars 13A and the longitudinal horizontal bars 13B may be about one to five bars. For example, the transverse horizontal bar 13A (FIG. 1) and longitudinal horizontal bar 13B (FIG. 1) are provided to match the height of the exerciser. Thus, when the transverse horizontal bar 13A (FIG. 1) and the longitudinal horizontal bar 13B (FIG. 1) are provided according to the height of the exerciser, the transverse horizontal bar 13A (FIG. 1) and the longitudinal horizontal bar 13B (FIG. 1) can be configured to facilitate gripping by the exerciser.

Comparative Example (Part 1)

Figure 9:
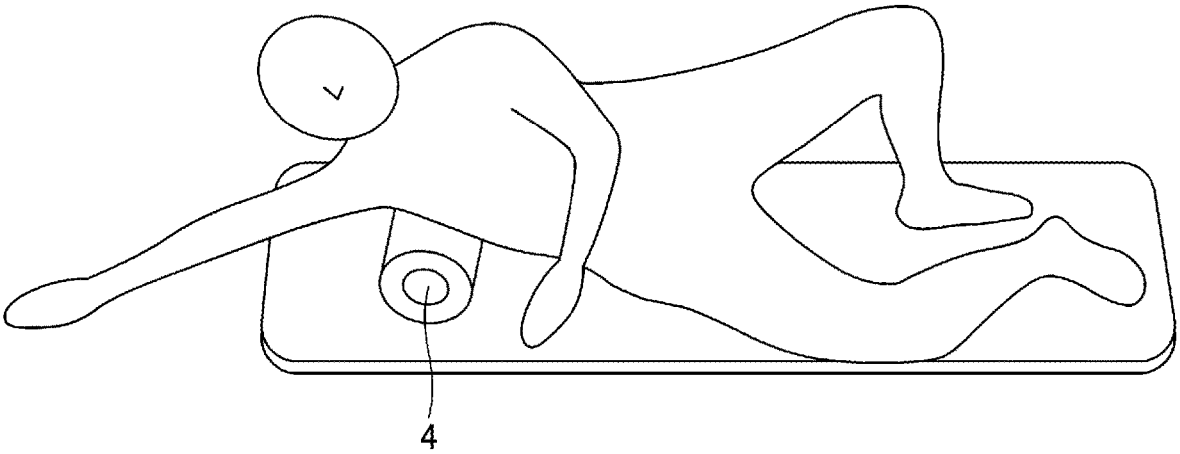
FIG. 9 is a diagram (Part 1) illustrating a comparative example.

FIG. 9 is a diagram (Part 1) illustrating a comparative example. Except for the example of the use (Part 2), exercises for stretching the latissimus dorsi muscles include exercises as illustrated in the drawings.

In order to exercise as illustrated in the Comparative Example, the exerciser needs to lie down on the floor, as illustrated. Such exercise requires time to get into posture, especially when the exerciser is an elderly person. In addition, the stress on the exerciser is high.

In addition, the exercise requires an equipment such as a, so-called pole 4 and the like. In addition, some exerciser may not know the position where to apply the pole 4.

Example of Use (Part 3)

Figure 10:
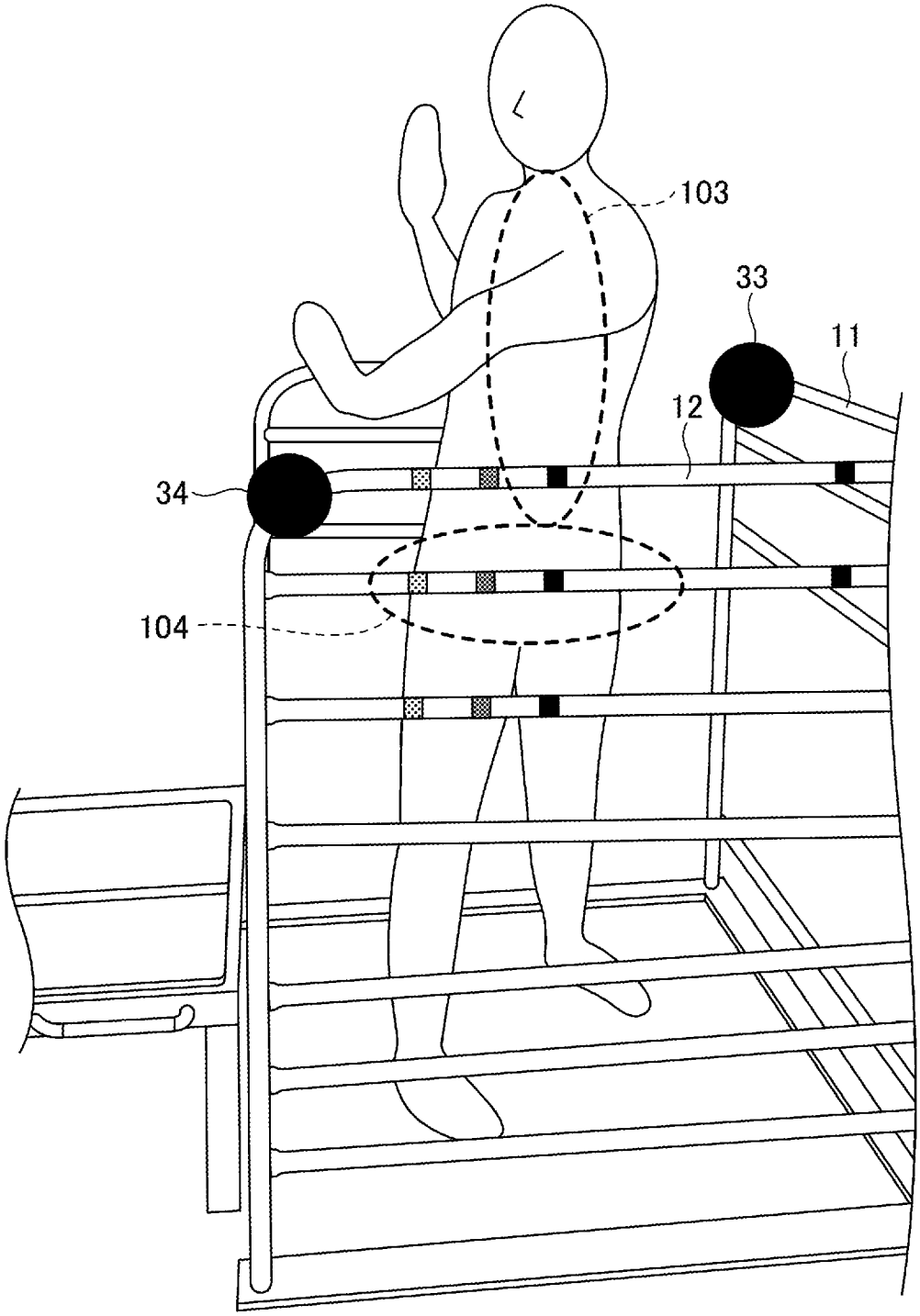
FIG. 10 is a diagram (Part 3) illustrating an example of the use of an exercise equipment of a modified example.

FIG. 10 is a diagram (Part 3) illustrating an example of the use of the exercise equipment in the modified embodiment. For example, the exercise equipment can be used as illustrated in the drawings. Specifically, it is desirable for the exercise equipment to be provided with marks 33 and 34, for example, in a position as illustrated. In the illustrated example, the exerciser performs a right-sided twisting exercise of the upper body. For example, such exercise is preferably performed for about 1 minute and 20 seconds.

The exerciser then tries to look at the mark 33 or the mark 34 in performing the exercise. When this line of sight, the body part 103, such as the upper part of the back, and the body part 104, such as the hip, are well pivoted. Thus, the presence of the mark 33, the mark 34 or the like allows the exerciser to recall the original exercise of the body part 103, the body part 104, and the like.

The bars may be, for example, a material such as a metal, a polymer, and the like. Each bar may also be of a different material. Specifically, the bars are mainly iron and the like. However, the bar may be wrapped with rubber or the like. The presence of such rubber or the like has the effect of preventing slippage.

In addition, since the bars are gripped by the exerciser, it is desirable that the diameters of the bars are large enough to be gripped.

Second Embodiment

<Example of Combination with Bed>

A preferred configuration of an exercise equipment includes a combination of a transverse horizontal bar, a longitudinal horizontal bar, and a vertical bar (hereinafter, referred to as a "frame") of the first embodiment with a bed. Specifically, for example, the exercise equipment may have the following configuration.

Figure 11:
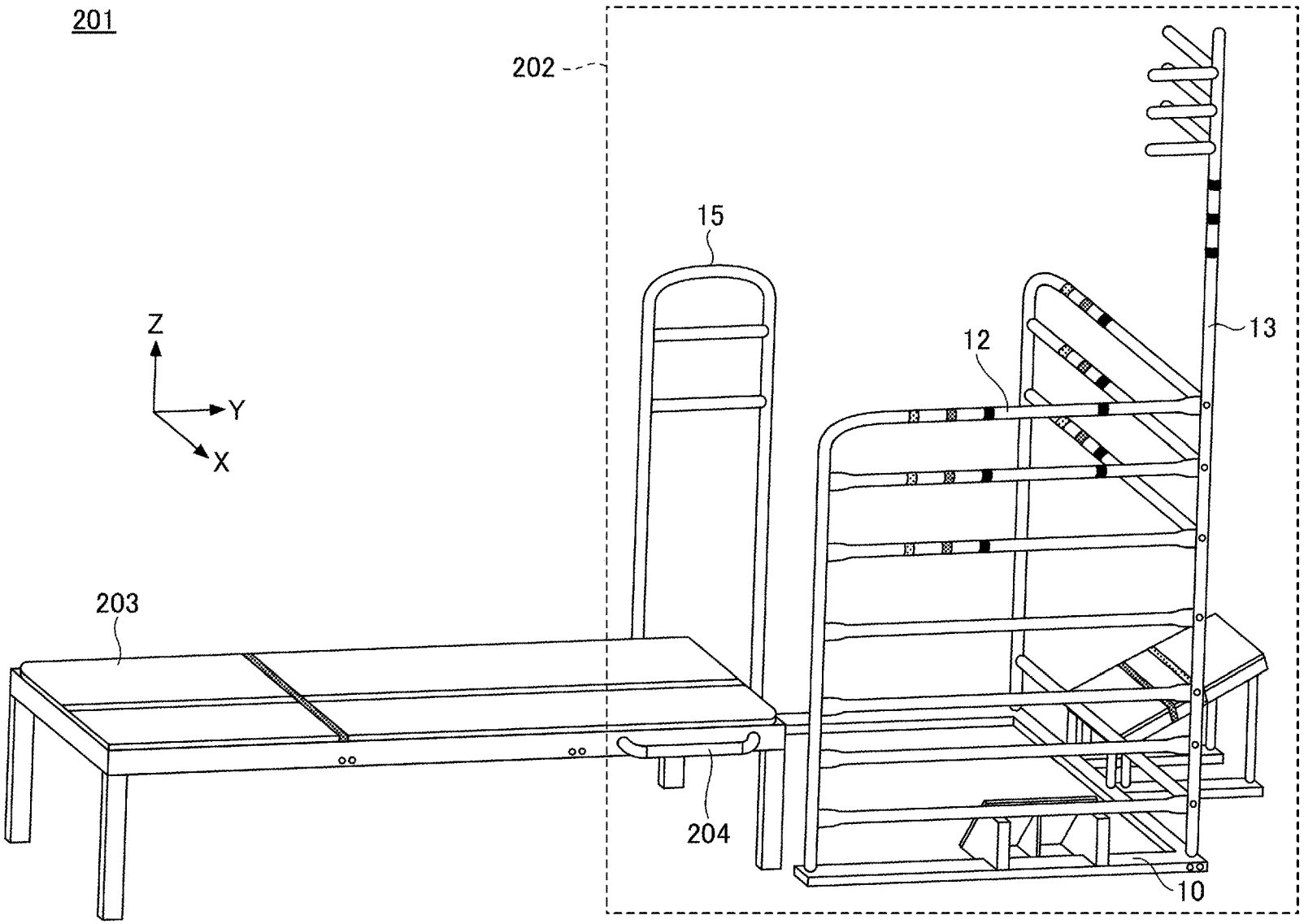
FIG. 11 is a diagram illustrating an exemplary entire configuration of an exercise equipment with a bed.

FIG. 11 is a diagram illustrating an entire configuration of an exercise equipment with a bed. For example, an exercise equipment 201 may be used with a frame 202 and a bed 203 being arranged such as illustrated.

That is, the bed 203 is placed adjacent to the frame 202. Thus, the exerciser can exercise using both the frame 202 and the bed 203. For example, an exerciser can exercise using the bed 203, the longitudinal horizontal bar 12, and the longitudinal horizontal bar 15.

The longitudinal horizontal bar 15 is placed so as to form a space 14 with the transverse horizontal bar 11. Then, the longitudinal horizontal bar 15 forms the space 14 and performs similar function as the transverse horizontal bar 11.

Figure 12:
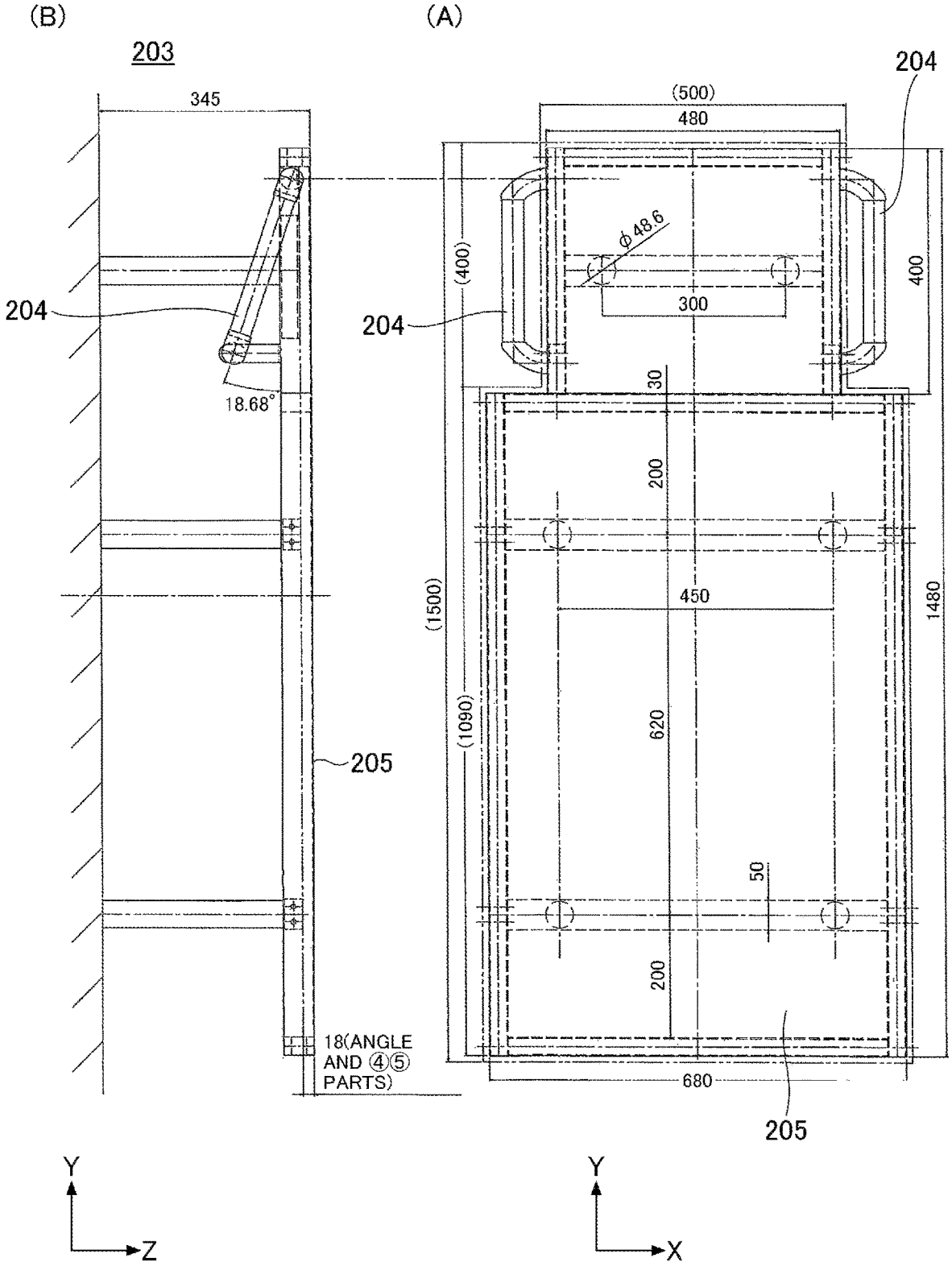
FIG. 12 is a diagram illustrating an example of a bed.

FIG. 12 is a diagram illustrating an example of a bed. FIG. 12(A) is a plan view of the bed. FIG. 12(B) is a side view of the bed.

A height of the bed 203 is preferably 400 mm or lower. The illustrated example is an example where the height of the bed 203 is 345 mm. Thus, the height of the bed 203 is preferably 350 mm or lower.

The height of the bed 203 is often between 450 mm and 550 mm. At such heights, the exerciser may feel scared of heights because the exerciser performs exercise lying on the bed 203. In contrast, when the height of the bed 203 is 400 mm or lower, the exerciser is less likely to feel scared of heights when the exerciser exercises lying on the bed 203.

Also, with such a bed 203, it is easier for the exerciser to lie down and get up than when lying on a floor.

Additionally, the bed 203 preferably has a bed surface 205 on which the exerciser can lie down or sit. Further, it is preferable that the bed surface 205 has a length in the depth direction of 1000 mm or longer. The example illustrated in the drawing is an example in which the length in the depth direction is 1090 mm. Such length in the depth direction allows the exerciser to place from the upper body to the toe on the bed surface 205, for example with knee-bending.

Such exercise equipment 201 allows, for example, the following exercise.

Example of Use (Part 4)

Figure 13:
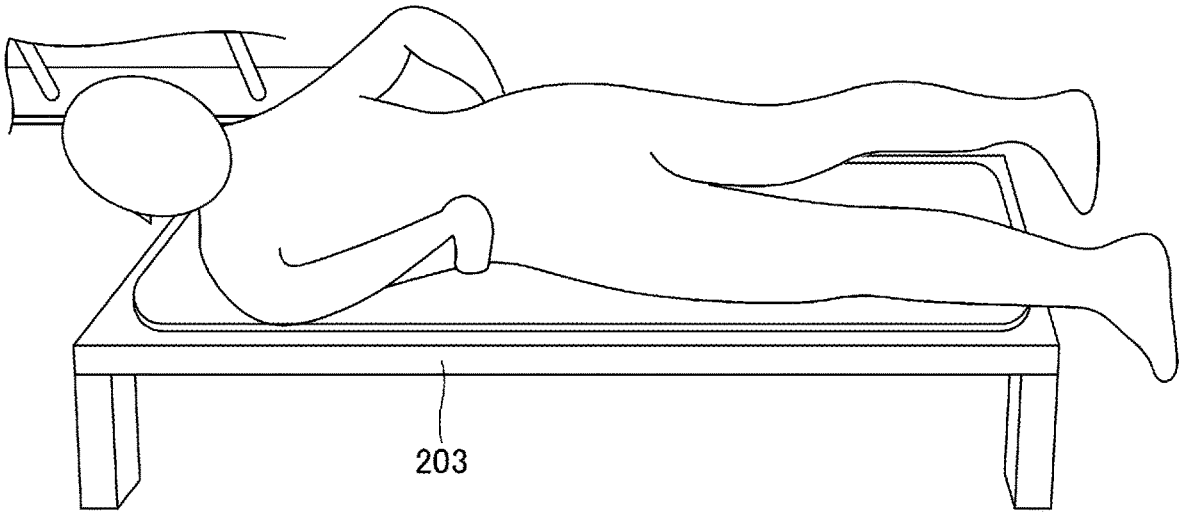
FIG. 13 is a diagram (Part 4) illustrating an example of the use of an exercise equipment of a modified example.

FIG. 13 is a diagram (Part 4) illustrating an example of the use of the exercise equipment in the modified embodiment. For example, the bed 203 may be used as illustrated. Specifically, in the illustrated example, the exerciser is allowed to lie down on the bed face down. Thus, when the height of the bed 203 is 400 mm or lower, it is easier for the exerciser to lie down and get up than when lying on a floor.

Comparative Example (Part 2)

Figure 14:
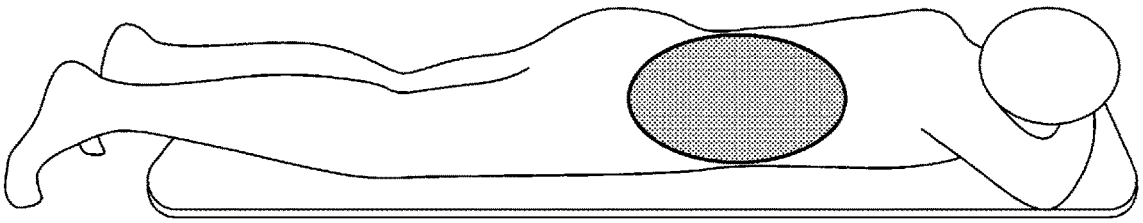
FIG. 14 is a diagram (Part 2) illustrating a comparative example.

FIG. 14 is a diagram (Part 2) illustrating a Comparative Example. For example, as illustrated, taking a position to lie down on a floor is more stressful for an exerciser than using a bed. Also, taking the position as illustrated often takes more time than using a bed.

Example of Use (Part 5 to 11)

Alternatively, the use of a bed 203 may facilitate exercise, such as lying down or sitting, as follows.

Figure 15:
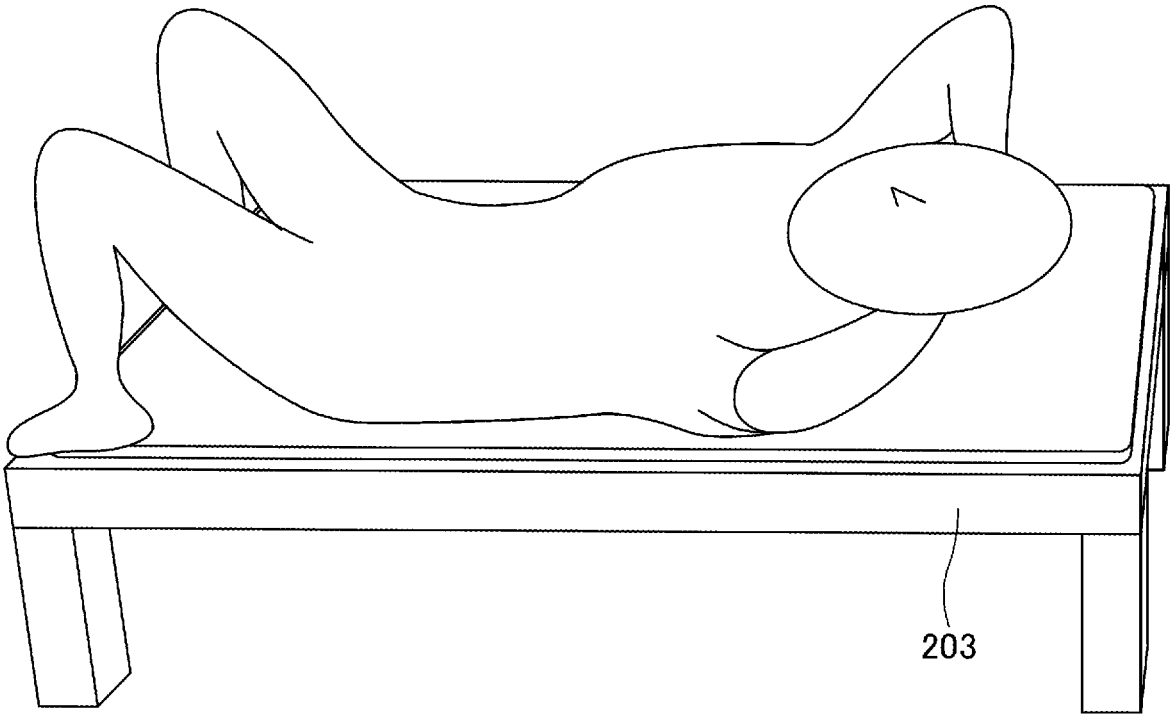
FIG. 15 is a diagram (Part 5) illustrating an example of the use of an exercise equipment of a modified example.

FIG. 15 is a diagram (Part 5) illustrating an example of the use of the exercise equipment in the modified embodiment.

Figure 16:
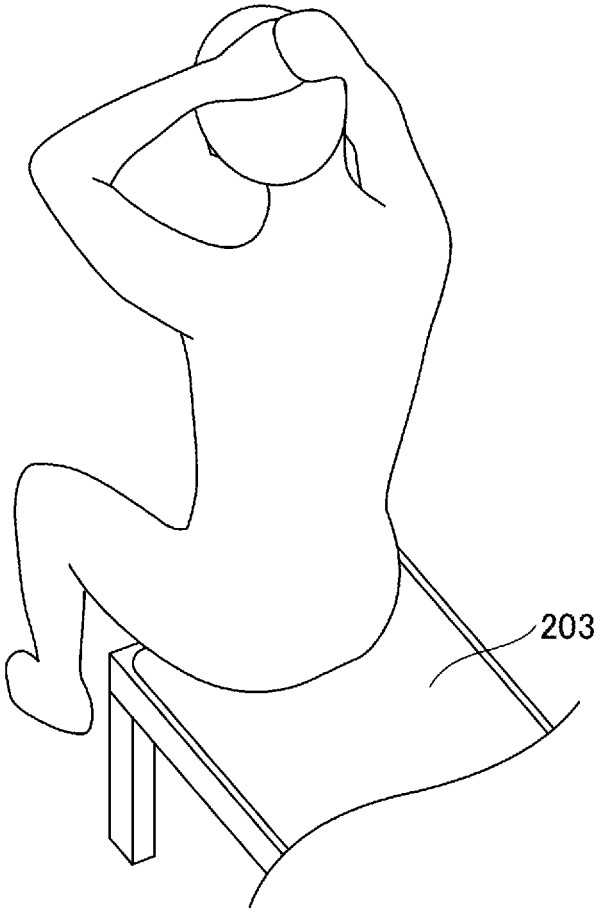
FIG. 16 is a diagram (Part 6) illustrating an example of the use of an exercise equipment of a modified example.

FIG. 16 is a diagram (Part 6) illustrating an example of the use of the exercise equipment in the modified embodiment.

Figure 17:
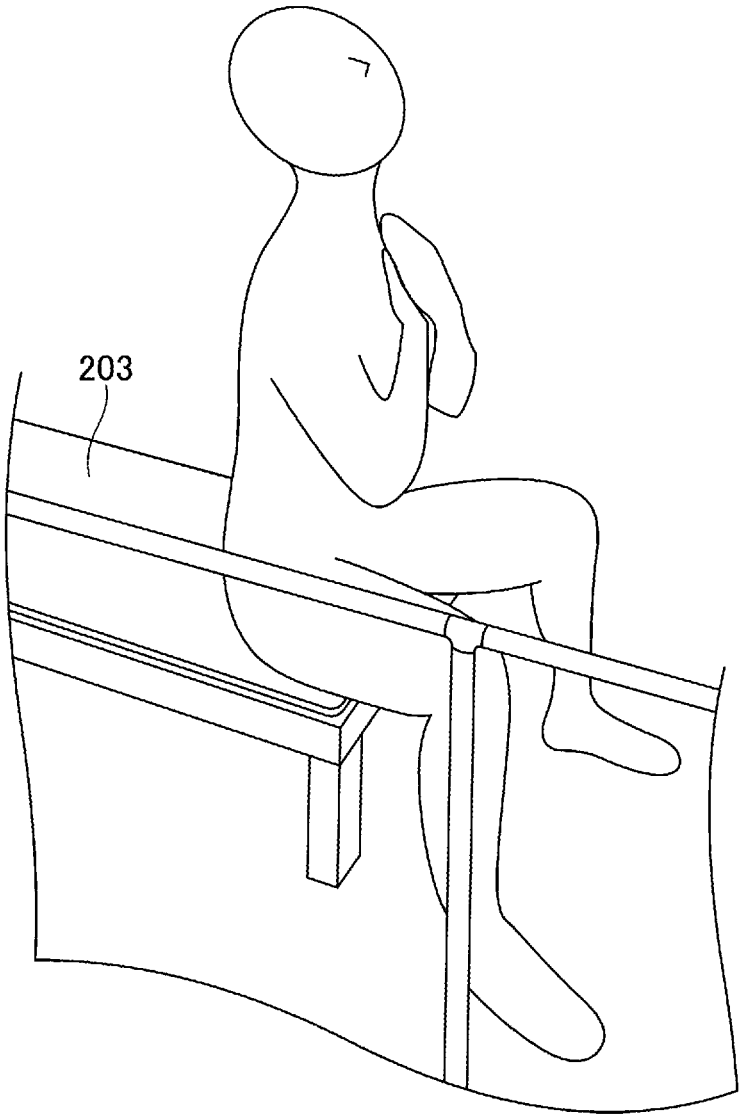
FIG. 17 is a diagram (Part 7) illustrating an example of the use of an exercise equipment of a modified example.

FIG. 17 is a diagram (Part 7) illustrating an example of the use of the exercise equipment in the modified embodiment.

Figure 18:
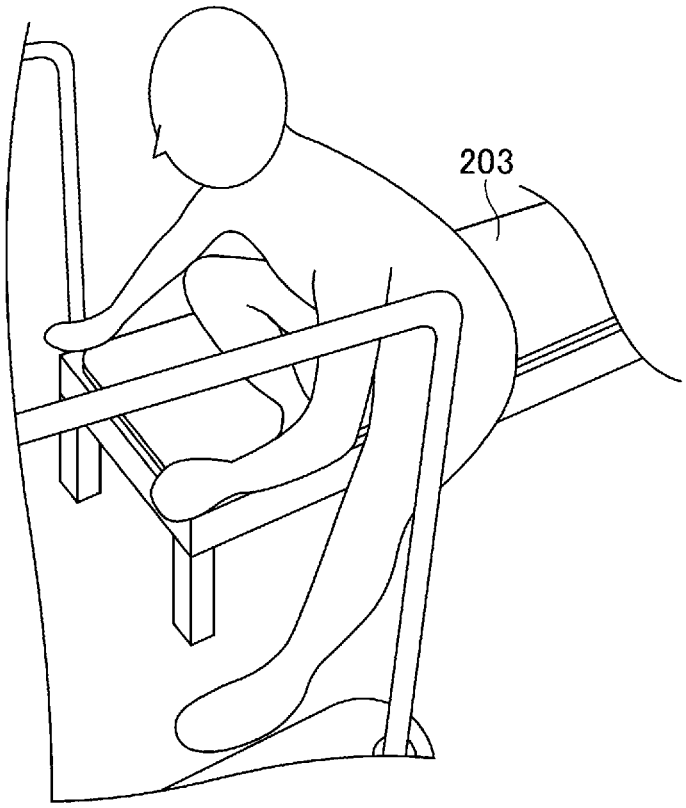
FIG. 18 is a diagram (Part 8) illustrating an example of the use of an exercise equipment of a modified example.

FIG. 18 is a diagram (Part 8) illustrating an example of the use of the exercise equipment in the modified embodiment.

Figure 19:
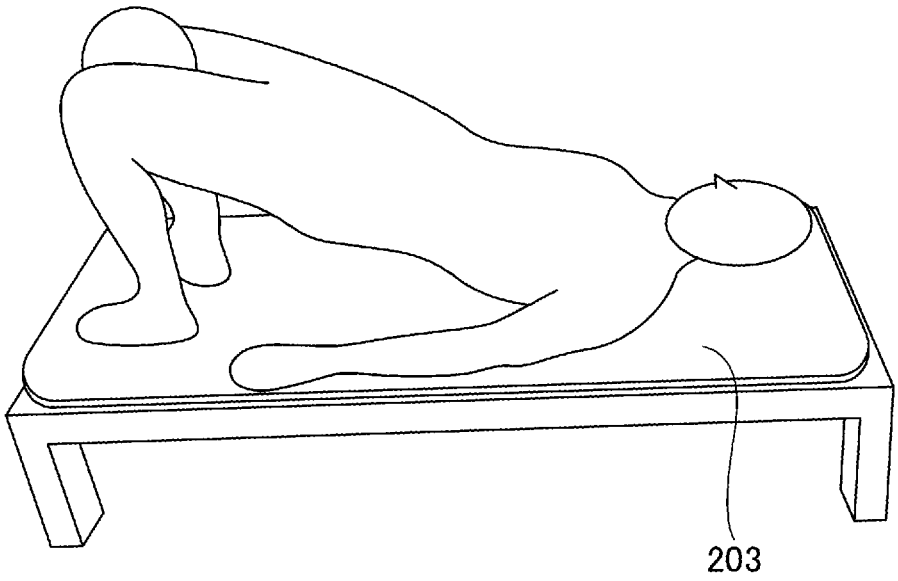
FIG. 19 is a diagram (Part 9) illustrating an example of the use of an exercise equipment of a modified example.

FIG. 19 is a diagram (Part 9) illustrating an example of the use of the exercise equipment in the modified embodiment.

Figure 20:
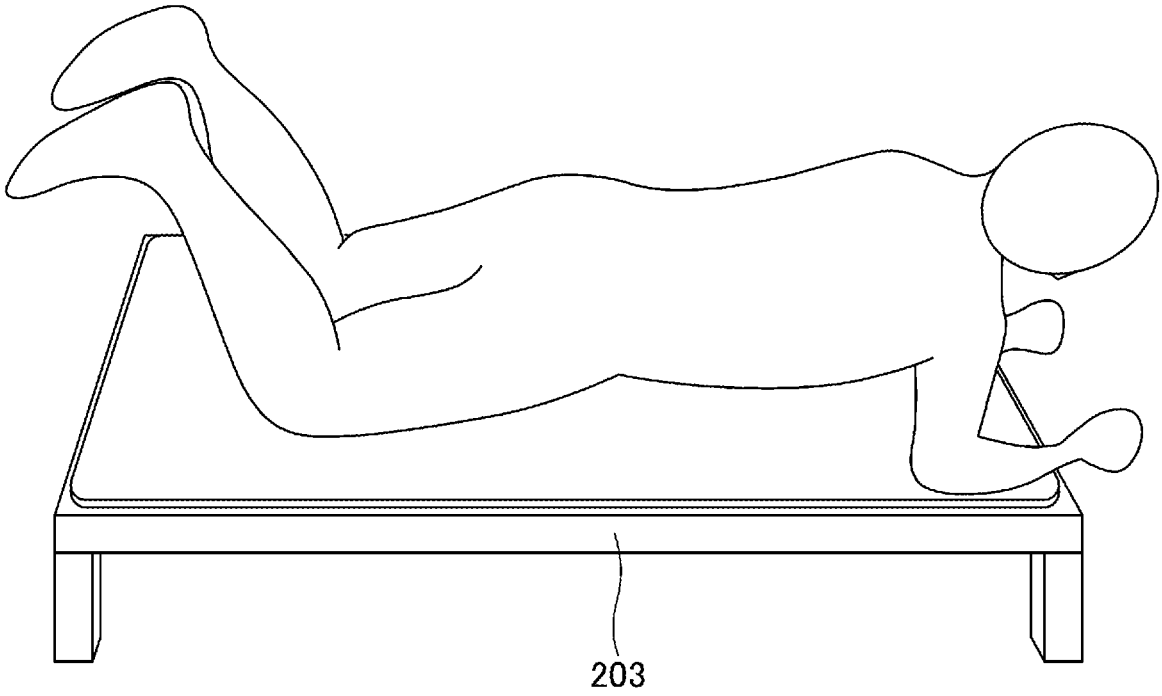
FIG. 20 is a diagram (Part 10) illustrating an example of the use of an exercise equipment of a modified example.

FIG. 20 is a diagram (Part 10) illustrating an example of the use of the exercise equipment in the modified embodiment.

Figure 21:
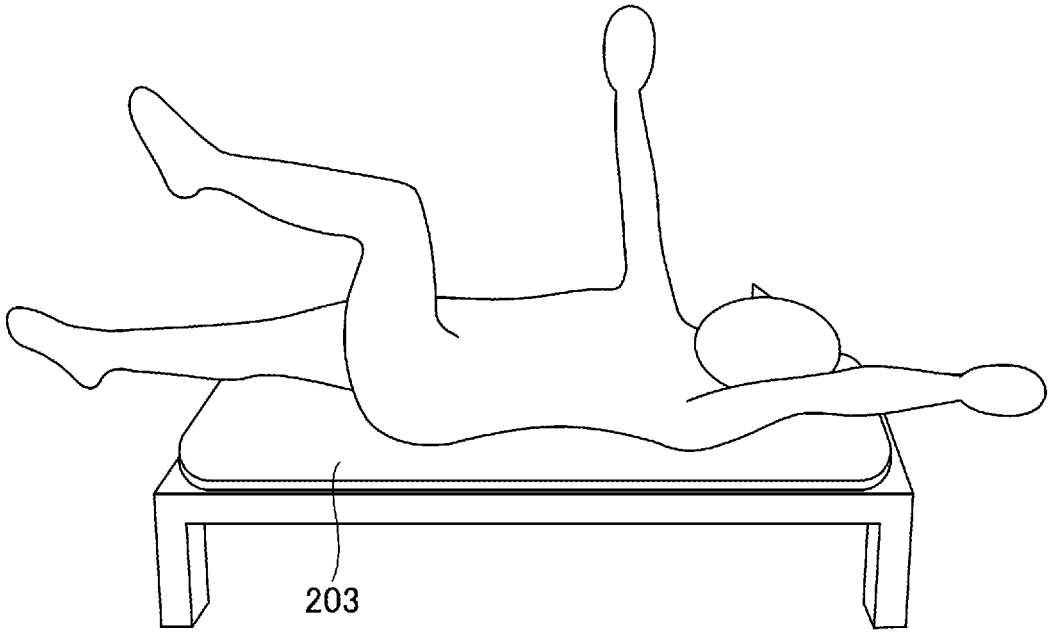
FIG. 21 is a diagram (Part 11) illustrating an example of the use of an exercise equipment of a modified example.

FIG. 21 is a diagram (Part 11) illustrating an example of the use of the exercise equipment in the modified embodiment.

Example of Use (Part 12)

Figure 22:
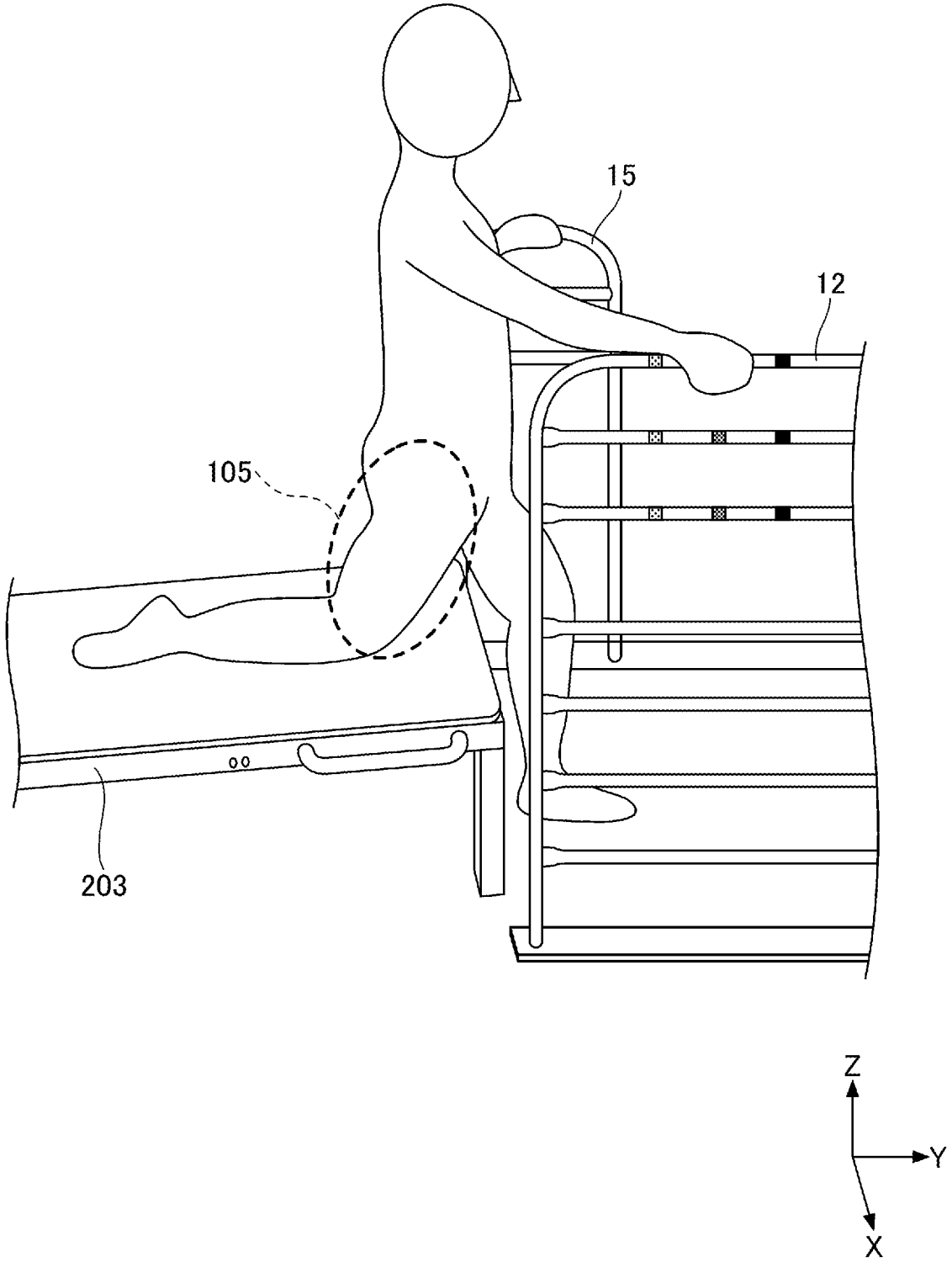
FIG. 22 is a diagram (Part 12) illustrating an example of the use of an exercise equipment of a modified example.

FIG. 22 is a diagram (Part 12) illustrating an example of the use of the exercise equipment in the modified embodiment. For example, the exercise equipment is used as illustrated. Specifically, in the illustrated example, the exerciser grips the longitudinal horizontal bar 12 with right hand. The exerciser grips the longitudinal horizontal bar 15 with the left hand. For example, such exercise is preferably performed for about 55 seconds.

With such exercise, the exerciser is able to stretch the body part 105, such as a, so-called iliopsoas muscle. Also, when the exerciser grips the longitudinal horizontal bar 12 and the longitudinal horizontal bar 15, the exerciser can stabilize the body even if the exerciser takes the posture as illustrated.

In addition, starting from the posture illustrated in the drawing, an exercise to move the right heel to the buttocks or the like may be performed.

Example of Use (Part 13)

In addition, it is desirable to have protrusions, such as handles, on the bed. With such handles, for example, the following exercise can be performed.

Figure 23:
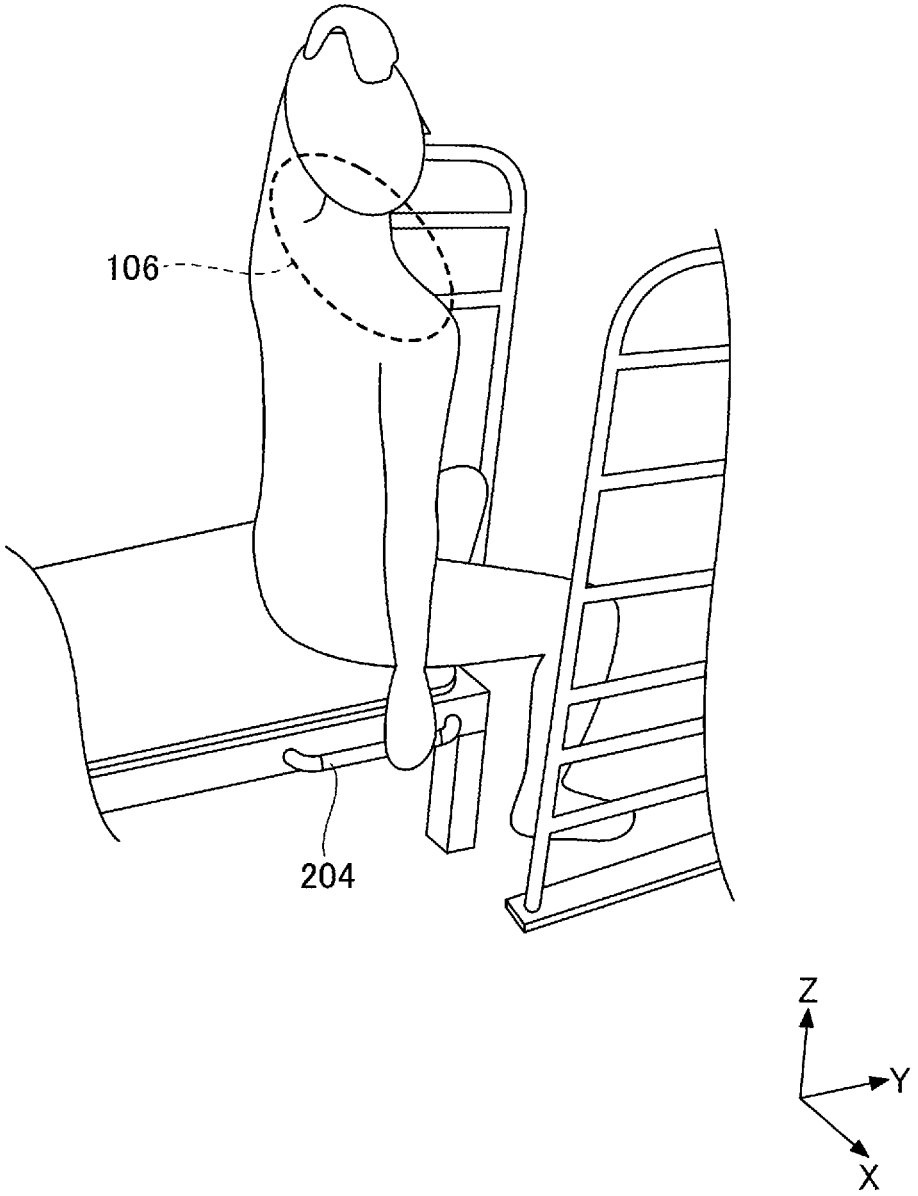
FIG. 23 is a diagram (Part 13) illustrating an example of the use of an exercise equipment of a modified example.

FIG. 23 is a diagram (Part 13) illustrating an example of the use of the exercise equipment in the modified embodiment. For example, the exercise equipment is used as illustrated. Specifically, in the illustrated example, first, the exerciser sits on a bed. The exerciser then grips a handle 204 with the right hand in a seated position. In addition, the exerciser supports the head with the left hand and tilts the neck toward left. For example, such exercise is preferably performed for about 30 seconds.

With such exercise, the exerciser is able to stretch a body part 106, such as a, so-called scalene muscle or the like. Also, with the handle 204, the exerciser can extend the side of the neck in the manner illustrated. That is, the exerciser can stretch the side of neck by moving the head away from the shoulder.

Third Embodiment

<Example of Combination with Ball>

A preferred configuration of an exercise equipment includes a combination of the frame with the bed as illustrated in the second embodiment and a ball such as a, so-called stretch ball. Specifically, for example, the exercise equipment may have the following configuration.

Figure 24:
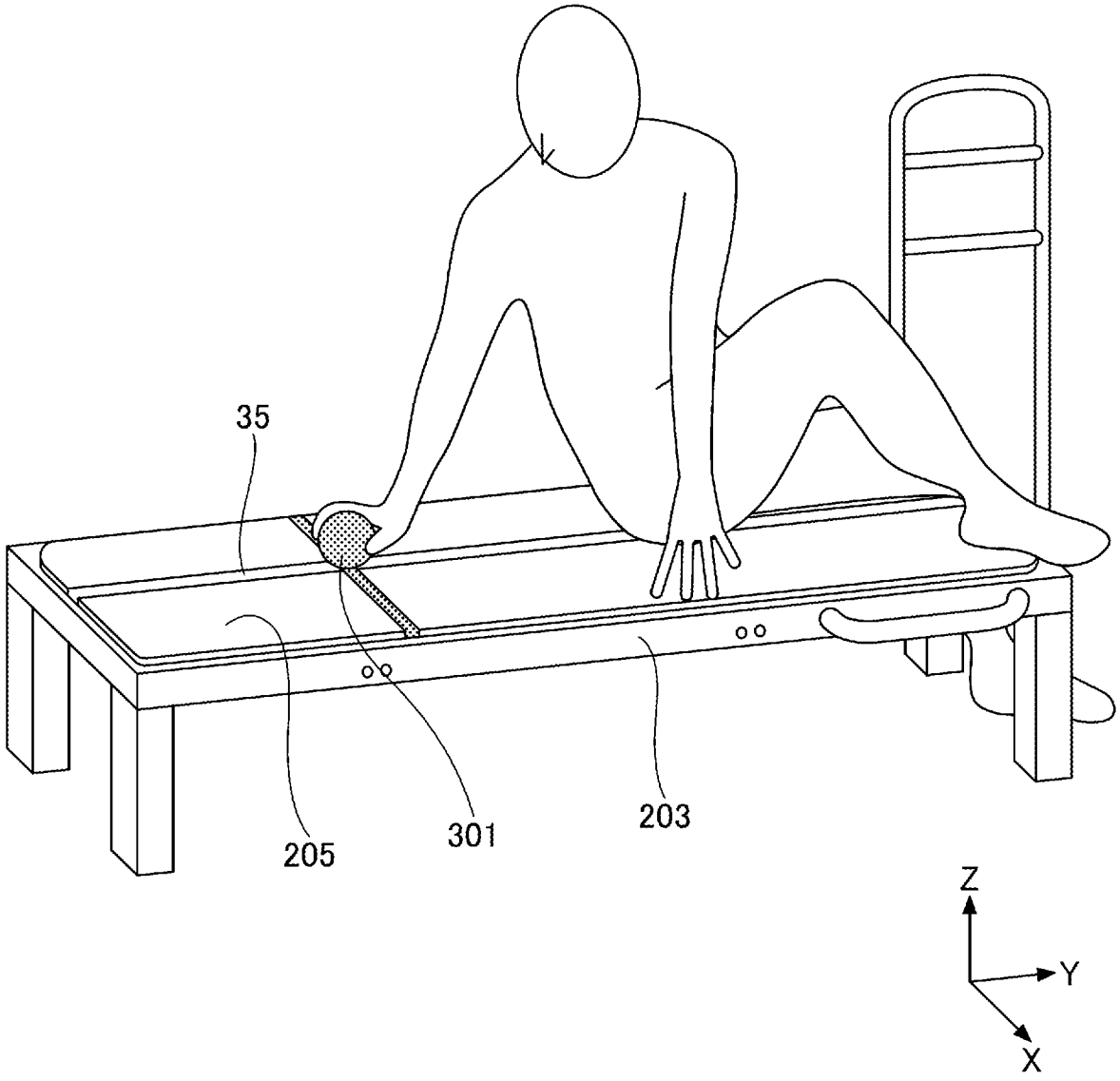
FIG. 24 is a diagram illustrating an exemplary entire configuration of an exercise equipment with a ball.

FIG. 24 is a diagram illustrating an exemplary entire configuration of an exercise equipment with a ball. The configuration will be explained in the following with an example of using a ball 301 to be sandwiched between an exerciser and a bed surface 205 of a bed 203.

In this example, as illustrated, the ball 301 is positioned on the bed surface 205 and the exerciser lies over the ball 301 to exercise.

As illustrated in the drawing, a mark 35 is preferably provided at the position where the ball 301 is placed. Thus, with the mark 35, the exerciser can easily understand where to place the ball 301.

Using the ball 301, for example, the following exercise can be performed.

Example of Use (Part 14)

Figure 25:
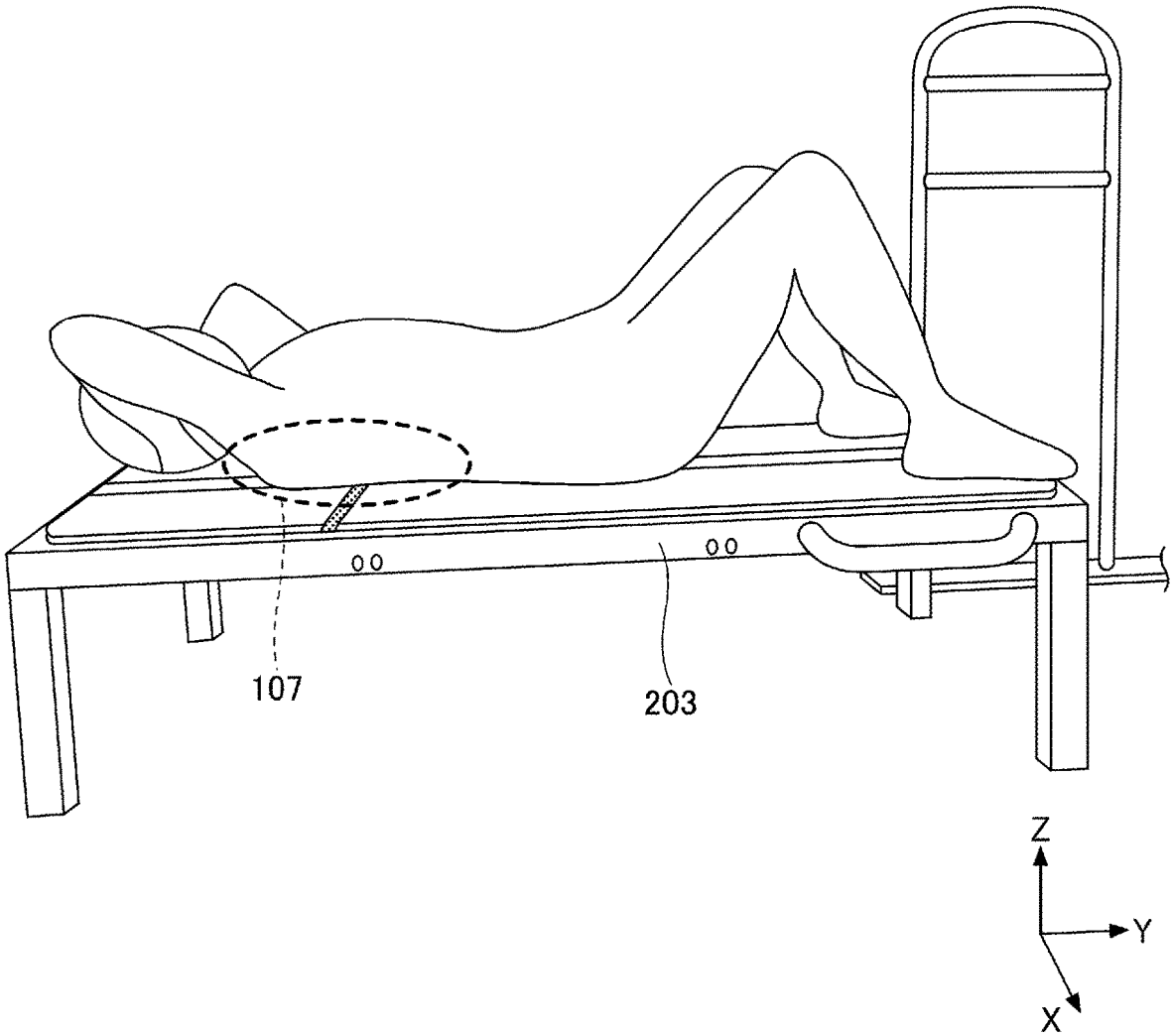
FIG. 25 is a diagram (Part 14) illustrating an example of the use of an exercise equipment of a modified example.

FIG. 25 is a diagram (Part 14) illustrating an example of the use of the exercise equipment in the modified embodiment. For example, the ball 301 (FIG. 24) and the like may be used as illustrated. Specifically, in the illustrated example, the exerciser first lies over the ball so that the exerciser places own weight on the ball 301 (FIG. 24). For example, such exercise is preferably performed for about 50 minutes.

With such exercise, the exerciser is able to stretch a body part 107, such as the back and the like.

Comparative Example (Part 3)

Figure 26:
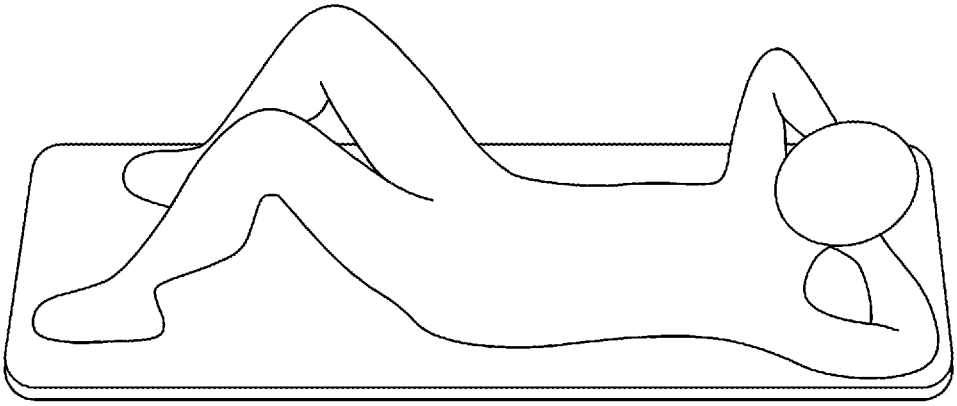
FIG. 26 is a diagram (Part 3) illustrating a comparative example.

FIG. 26 is a diagram (Part 3) illustrating a Comparative Example. For example, to stretch the body part 107 (FIG. 25), the exerciser needs to take a posture as illustrated. Thus, taking a posture to lie on a floor is more stressful for the exerciser than using a bed. Also, taking the posture as illustrated often takes more time than using a bed. In addition, when a ball or the like is used, it is often difficult to know whether or not the body part 107 (FIG. 25) is properly on the ball to stretch the body part 107.

Fourth Embodiment

Example of Combination with Exercise Stand

A preferred configuration of an exercise equipment includes a configuration in which an exercise stand 16 is placed on the frame. Specifically, for example, the exercise equipment is configured to place the exercise stand 16 on the first transverse horizontal bar, as illustrated in FIG. 1. With such an exercise stand 16, for example, the following exercise can be performed.

Example of Use (Part 15)

Figure 27:
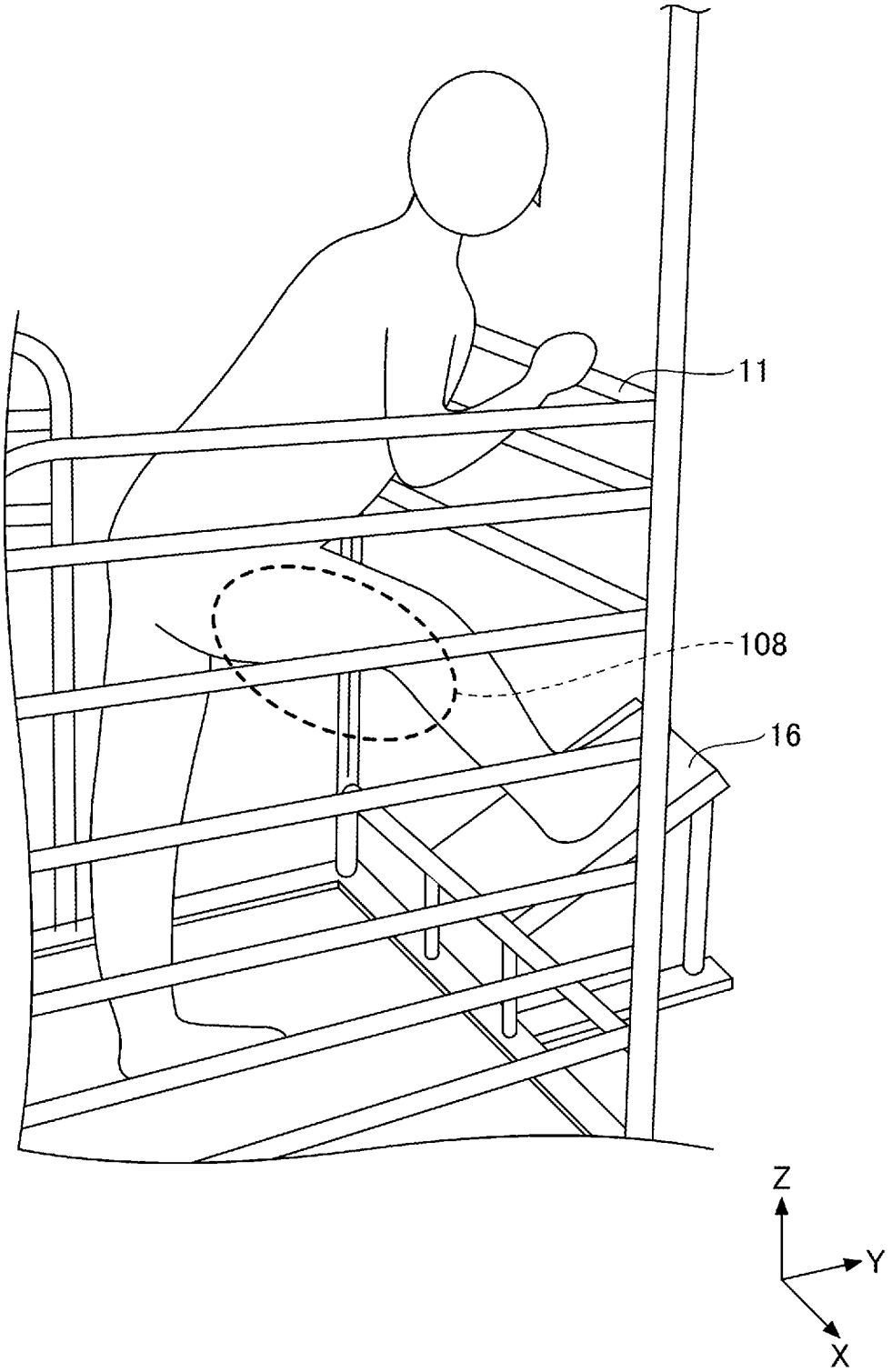
FIG. 27 is a diagram (Part 15) illustrating an example of the use of an exercise equipment of a modified example.

FIG. 27 is a diagram (Part 15) illustrating an example of the use of the exercise equipment in the modified embodiment. For example, the exercise stand 16 may be used as illustrated. Specifically, in the illustrated example, the exerciser first places the right foot on the exercise stand 16. For example, such exercise is preferably performed for about 50 seconds.

With such exercise, the exerciser can stretch a body part 108, such as, so-called hamstrings. The presence of the transverse horizontal bar 11 or the like also allows the exerciser to stabilize the body even in the posture illustrated.

The exercise stand 16 is preferably located at a height of 250 mm or lower. With such height, even an exerciser with a pain in the knee can easily exercise to extend the body part 108. In contrast, when the exercise stand 16 is placed at a high position, the exerciser with a pain in the knee may have difficulty exercising because the exerciser may not reach the exercise stand, or the exerciser may have to raise the feet to the level at which the pain is felt.

Comparative Example 4

Figure 28:
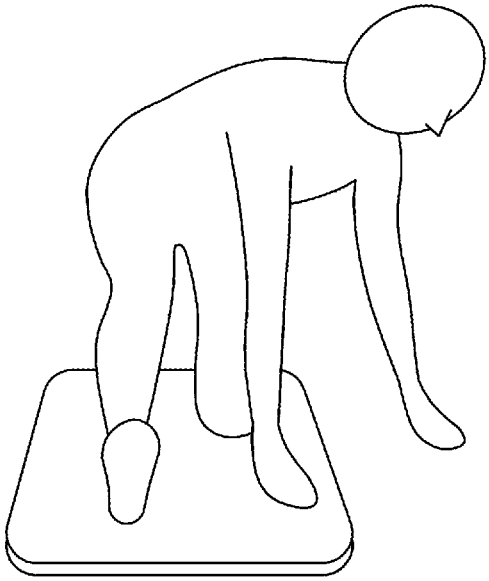
FIG. 28 is a diagram illustrating a comparative example (Part 4).

FIG. 28 is a diagram (Part 4) illustrating a Comparison Example. For example, it is necessary to take the posture to stretch the body part 108 (FIG. 27) as illustrated, and taking the posture as illustrated often takes more time.

In addition, a person with a stiff body often stretches other parts of the body in such a posture. Thus, a person with a stiff body may have a possibility to injure other parts of the body if the person takes such a posture.

Example of Use (Part 16)

Alternatively, the exercise stand may have the following configuration, for example.

Figure 29:
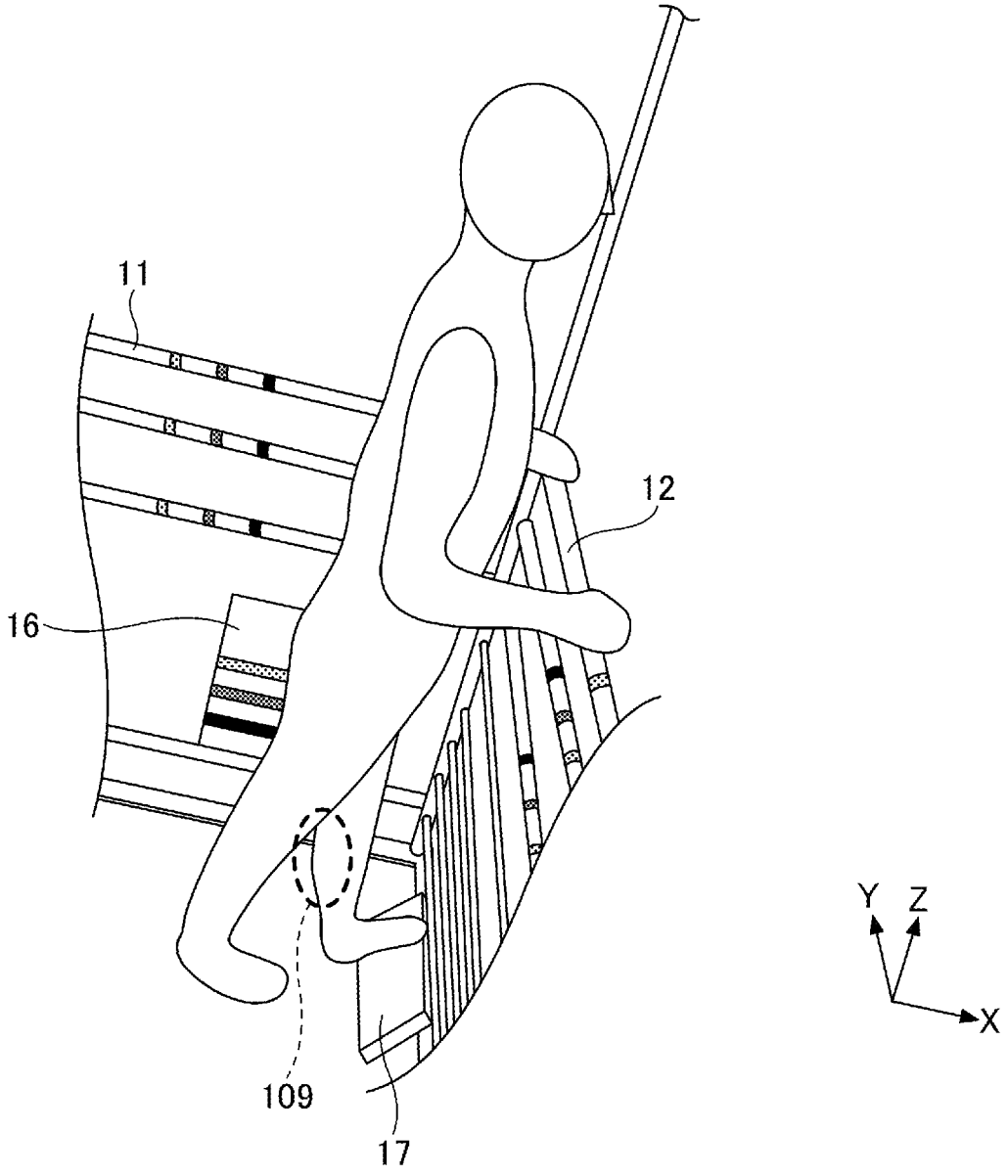
FIG. 29 is a diagram (Part 16) illustrating an example of the use of an exercise equipment of a modified example.

FIG. 29 is a diagram (Part 16) illustrating an example of the use of the exercise equipment in the modified embodiment. As illustrated, the exercise equipment may be configured with an exercise stand 17. The example illustrated is an example in which the exercise stand 17 is placed on a longitudinal horizontal bar 12 apart from the exercise stand 16. Specifically, in the illustrated example, the exerciser first places the left foot on the exercise stand 17. For example, such exercise is preferably performed for about 60 seconds.

With such exercise, the exerciser is able to stretch a body part 109, such as a, so-called calf. Also, with the longitudinal horizontal bar 12 or the like, the exerciser can stabilize the body even if the exerciser takes the posture as illustrated.

The exercise stand 16 and the exercise stand 17 may not be positioned as illustrated. For example, the positions of the exercise stand 16 and exercise stand 17 may be switched. Alternatively, the exercise stand 16 and exercise stand 17 may be of a replaceable type or another exercise stand may be used with.

Fifth Embodiment

A preferred configuration of an exercise equipment includes a configuration of a combination of the frame in the first embodiment with an elastic body such as a tube. Specifically, for example, the exercise equipment may have the following configuration.

Example of Use (Part 17)

Figure 30:
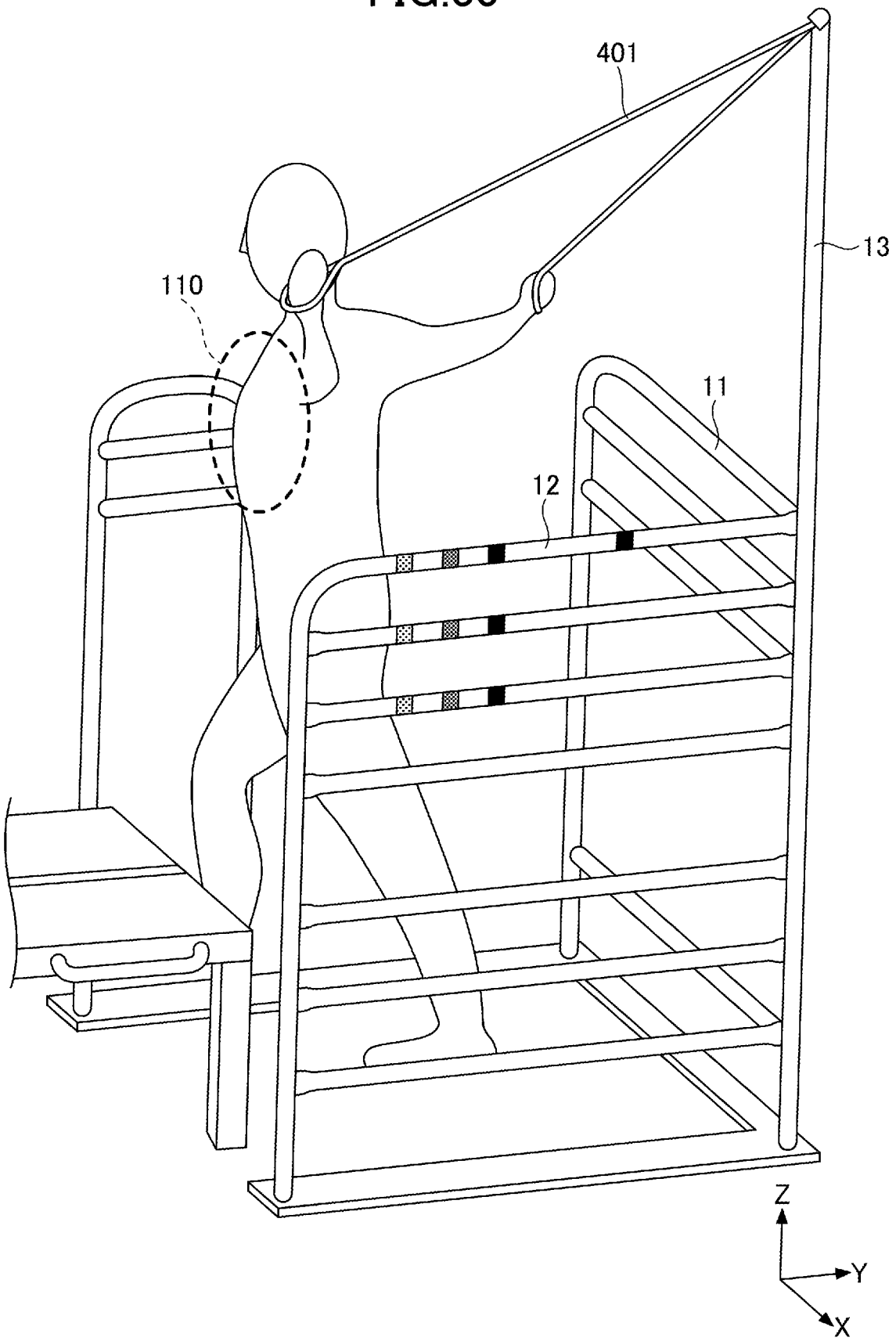
FIG. 30 is a diagram (Part 17) illustrating an example of the use of an exercise equipment of a modified example.

FIG. 30 is a diagram (Part 17) illustrating an example of the use of the exercise equipment in the modified embodiment. For example, a tube 401 attached to a vertical bar 13 is used as illustrated. Specifically, in the illustrated example, an exerciser holds the tube 401 with both hands and pulls forward. For example, such exercise is preferably performed for about 20 seconds.

With such exercise, the exerciser can stretch a body part 110, such as a, so-called anterior chest. The height, length, hardness, and the like of the tube 401 is desirably adjustable. Among exercisers, some of them may have shoulder pain. Thus, the tube 401 is desirably adjusted to be painless on their shoulder.

The elastic body may not be a tube. For example, the elastic body may be a spring, wire, rubber, rope, or the like. That is, the elastic body may be formed of a material capable of expanding and contracting to a certain extent with the strength of a human arm.

Other Exercise Examples

For example, the following exercises may be combined with the above-described exercises and the like to perform the exercises.

Figure 31:
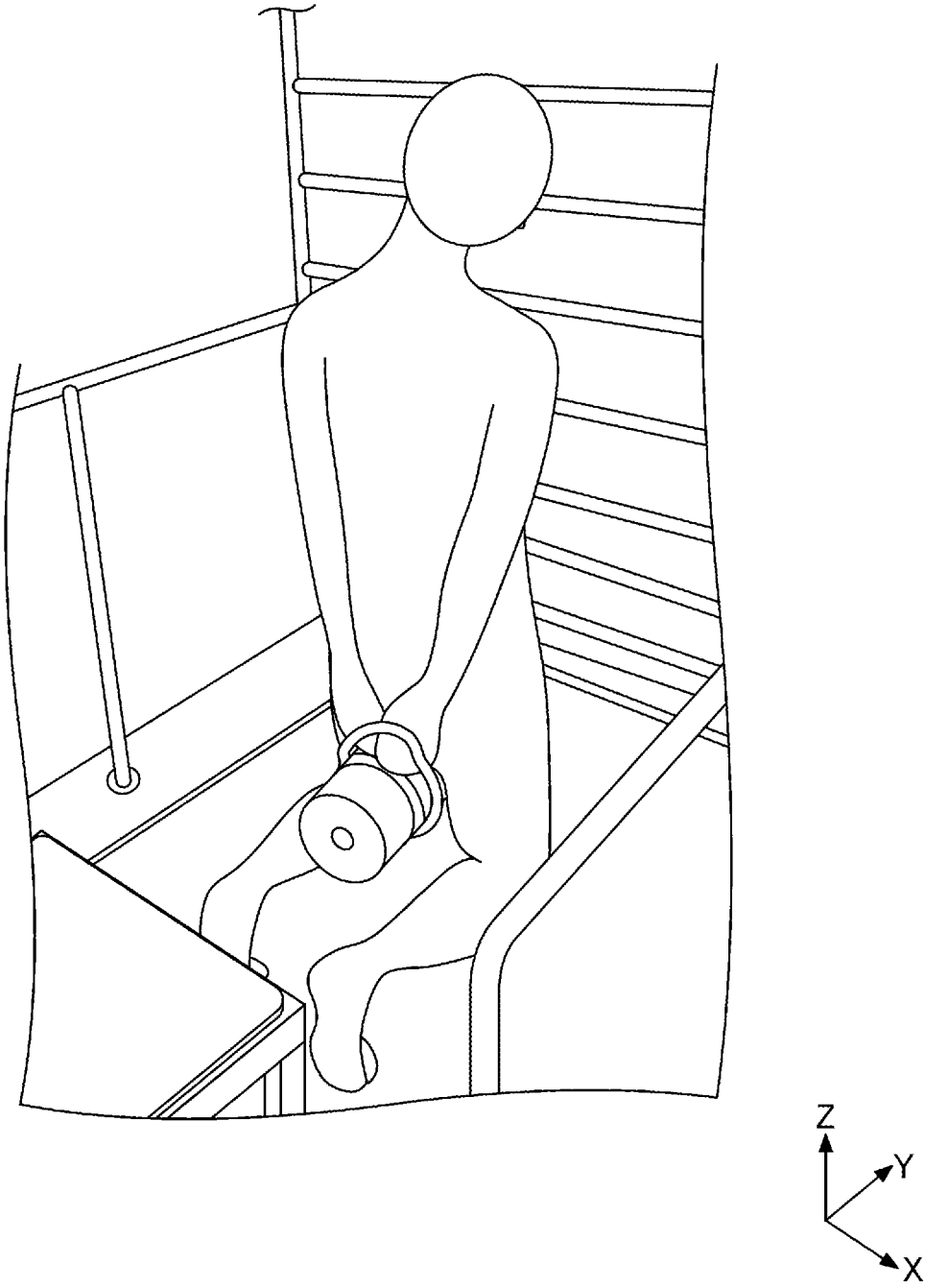
FIG. 31 is a diagram illustrating other examples of exercise (Part 1).

FIG. 31 is a diagram illustrating other exercise examples (Part 1).

Figure 32:
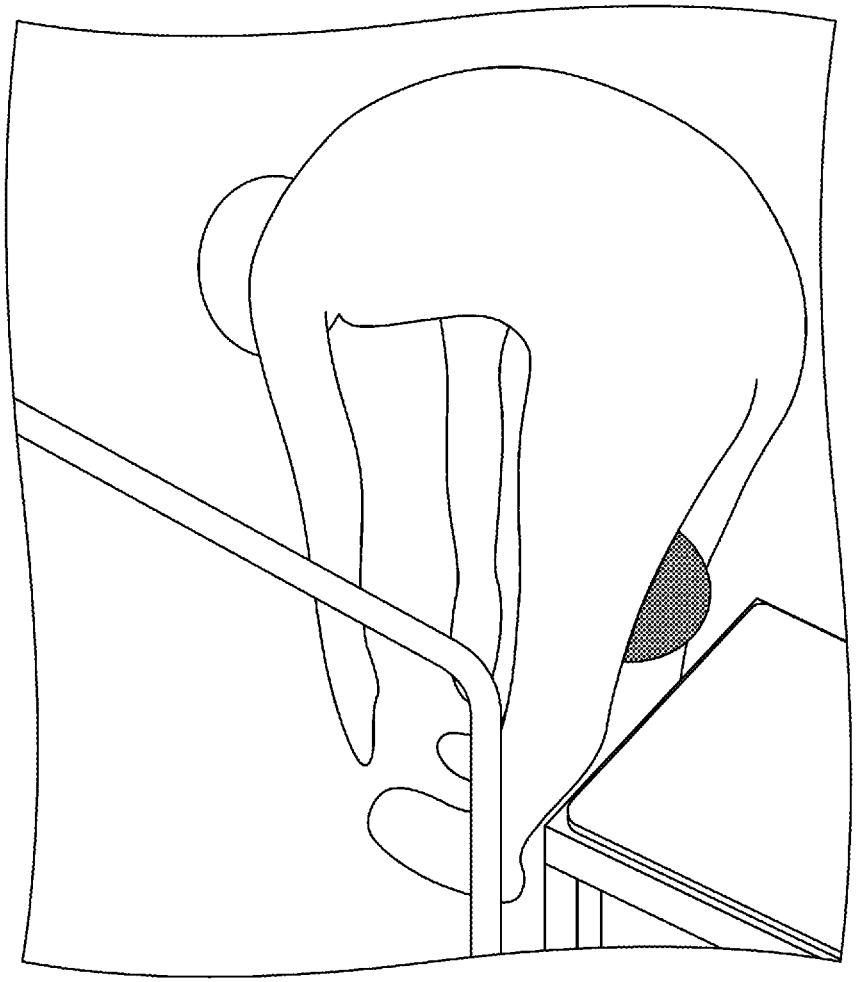
FIG. 32 is a diagram illustrating other examples of exercise (Part 2).

FIG. 32 is a diagram illustrating other exercise examples (Part 2).

Figure 33:
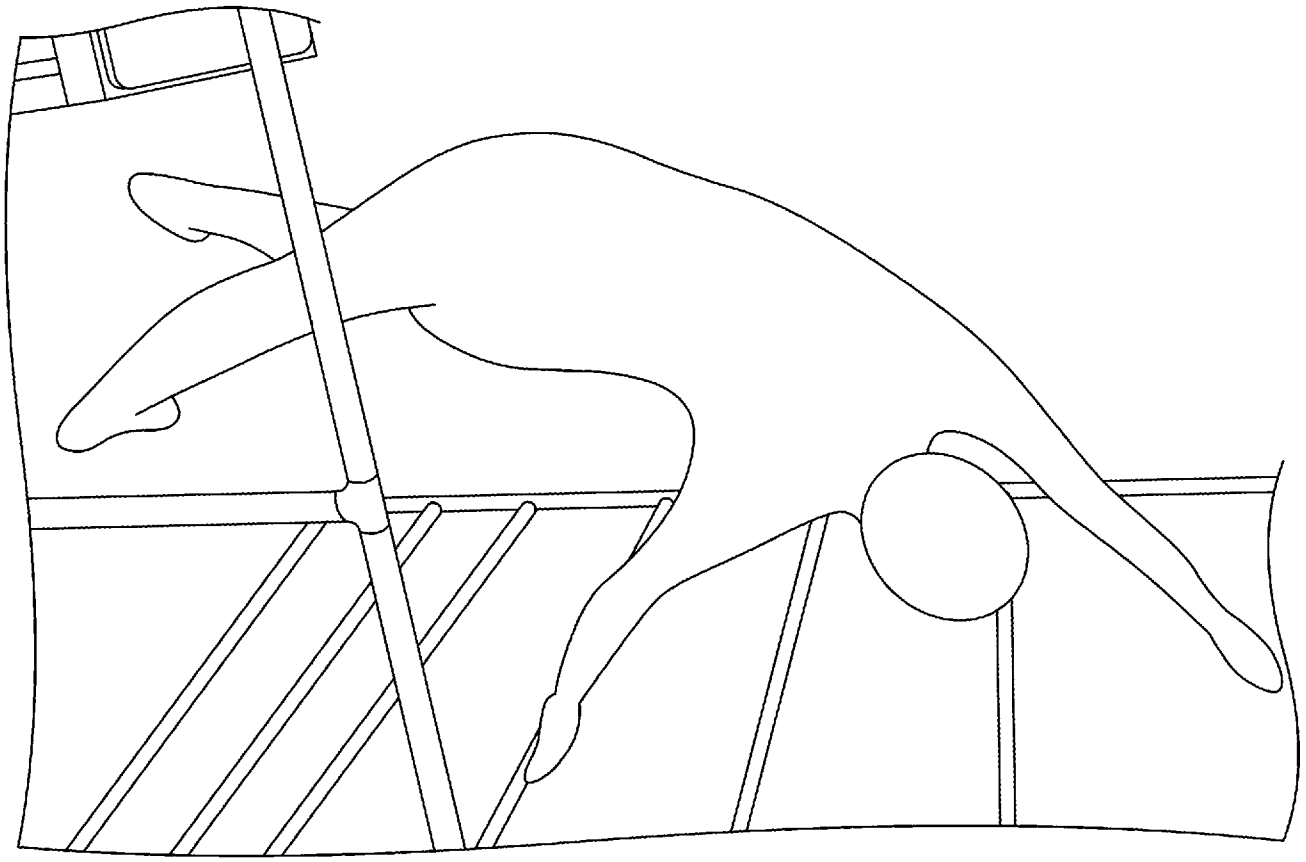
FIG. 33 is a diagram illustrating other examples of exercise (Part 3).

FIG. 33 is a diagram illustrating other exercise examples (Part 3). The exercises illustrated in the drawing may be such as the exercise of gripping the longitudinal horizontal bar 12 (FIG. 1) or the longitudinal horizontal bar 15 (FIG. 1) with the lower hand without any gripping by the upper hand.

The exercise equipment may also include the arrangement and shape of the longitudinal horizontal bars and transverse horizontal bars as illustrated in the drawings in accordance with exercises.

When the exercise is performed in a standing or sitting posture as described above and when the exercise is performed in a lying posture, the stress for the exerciser to change the posture can be reduced if the frame and the like are provided. Also, the time for the exerciser to change the posture can be reduced.

[Parallel Plates]

The exercise equipment includes the frame having a parallel plate in which the plate is parallel to the floor surface, and a thickness of the parallel plate is 3.2 mm. For example, as illustrated in FIG. 1, the exercise equipment is preferably provided with a plate that is close to a floor surface (hereinafter, referred to as a "parallel plate 501"). That is, the area surrounded by the frame 10 (FIG. 1) is preferably flat. Thus, when the parallel plate 501 is provided, the surface on which an exerciser performs an exercise is flat, and the exercise is facilitated. Some exercise cannot be performed without flat surfaces or are ineffective. For example, as in Non-Patent Document 1, if a floor surface with an angle is used for exercise, it may be necessary to further secure a flat surface and require a large space. Thus, the exercise equipment as illustrated in FIG. 1 can make effective use of space or perform exercise easier.

Further, a mat or the like may be further laid on the parallel plate 501. Further, a mark may be provided at a position where the foot is placed on the parallel plate 501.

[Summary]

For example, an exercise equipment constituted by bars as described above has fewer bars and reduces a feel of pressure on exerciser. Particularly in a configuration where a bar is located in the upper portion of the exerciser, such as in Non-Patent Document 1, the exerciser is prone to feeling pressure. When the exerciser feels pressure, the exerciser is more likely to give up. In contrast, the above-described configuration of the exercise equipment makes it easier for an exerciser to exercise. In addition, when a monitor or the like is installed on an exercise device with few bars, the number of objects blocking the monitor is reduced, so that the exerciser can easily see the image on the monitor.

The exercise equipment as described above can be used to perform exercise without causing pain at the body parts. Thus, an exerciser can heal the pain by moving the shoulders, knees, and hips.

Exercise equipment such as those described above can help the exerciser to take a posture or make it easier to understand how to take a posture, thus shortening the time required for the exerciser to take a posture. In addition, an exerciser can easily find a balance because the exercise equipment has a structure to support the body, and the exerciser can ensure safety.

As described above, using the exercise equipment makes it easier to understand the line of sight or position of the hand, so that an exerciser and a person who gives advice to the exerciser can easily and efficiently judge whether the position or movement in the exercise is appropriate. In addition, exercisers are more likely to feel that exercise is effective.

This effect is particularly remarkable in the case of an elderly person.

Other Embodiments

The transverse horizontal bars, longitudinal horizontal bars, and vertical bars are not completely parallel in each direction. That is, the transverse horizontal bars, the longitudinal horizontal bars, and the vertical bars may be placed in a horizontal direction, a depth direction, and a vertical direction to some extent, and the bars may be placed at an angle such that the bars intersect each other by approximately 90 degrees. The number of transverse horizontal bars, longitudinal horizontal bars, and vertical bars is not limited to the number illustrated in the drawings.

The exercise equipment of the present invention is not limited to the above-described embodiments. For example, the arrangement, color, shape, size, number of bars, and the like of the components may take other forms than those described above.

The present invention is not limited to the above-described configurations, such as the configurations illustrated in the above-described embodiments, combinations with other elements, and the like. In these respects, it is possible to change the scope of the invention without departing from the spirit of the invention, and determinations can be appropriately made in accordance with the application form.

What is claimed is:

1. An exercise equipment configured to be arranged on a floor, comprising: a frame having a shape that lacks one side of a rectangle and configured to surround an exerciser, a first longitudinal horizontal bar connected to the frame, arranged at a predetermined height from the frame, and aligned in a depth direction;

a first transverse horizontal bar connected to the frame, having one end thereof connected to the first longitudinal horizontal bar, and aligned in a direction different from the first longitudinal horizontal bar;

a vertical bar connected to the frame, and having a height from the frame that is higher than the first transverse horizontal bar; and a second longitudinal horizontal bar connected to the frame, arranged in parallel to the first longitudinal horizontal bar, and spaced from another end of the first transverse horizontal bar, wherein a space is provided between the first transverse horizontal bar and the second longitudinal horizontal bar, wherein the space is provided inside the frame so as not to place any bars parallel to the first longitudinal horizontal bar or the first transverse horizontal bar, wherein the first transverse horizontal bar and the second longitudinal horizontal bar are arranged at same height, wherein the first transverse horizontal bar and the first longitudinal horizontal bar are connected to the vertical bar, wherein the first longitudinal horizontal bar and the second longitudinal horizontal bar are spaced apart, wherein the first longitudinal horizontal bar, the first transverse horizontal bar, and the second longitudinal horizontal bar are arranged so as to surround the exerciser, and wherein the first transverse horizontal bar includes a portion protruding outward from the frame.

2. The exercise equipment according to claim 1, further comprising a bed, wherein the bed has a surface on which the exerciser can lie down or sit, and a height of the bed is 400 mm or lower.

3. The exercise equipment according to claim 2, further comprising a ball configured to be sandwiched between an exerciser and the bed surface.

4. The exercise equipment according to claim 2, further comprising a protruding portion on the bed, wherein the exerciser can sit on the bed surface, and the protruding portion is provided on a surface other than the bed surface.

5. The exercise equipment according to claim 2, wherein a length of the bed surface in the depth direction is 1000 mm or longer.

6. The exercise equipment according to claim 1, wherein the first transverse horizontal bar or the first longitudinal horizontal bar is provided with an exercise stand, wherein the exercise stand is positioned at a height of 250 mm or lower, and wherein the exercise stand is placed outside of the frame.

7. The exercise equipment according to claim 1, wherein a mark is provided on the first transverse horizontal bar, the first longitudinal horizontal bar, the second longitudinal horizontal bar, or the vertical bar.

8. The exercise equipment according to claim 1, wherein the vertical bar has a second transverse horizontal bar or a third longitudinal horizontal bar at a position higher than the first longitudinal horizontal bar.

9. The exercise equipment according to claim 1, wherein an elastic body is attached to the vertical bar.

10. The exercise equipment according to claim 1, wherein the frame includes a parallel plate in which the plate is parallel to the floor surface, and a thickness of the plate is 3.2 mm.

* * * * *